US010809666B2

(12) United States Patent
Markan et al.

(10) Patent No.: US 10,809,666 B2
(45) Date of Patent: Oct. 20, 2020

(54) LOW-PROFILE BAND LATCH MECHANISM

(71) Applicant: Fitbit, Inc., San Francisco, CA (US)

(72) Inventors: Patrick James Markan, San Francisco, CA (US); Jeffrey Andrew Fisher, Mountain View, CA (US); Benjamin Patrick Robert Jean Riot, San Francisco, CA (US); Yu Chuan Kang, Taipei (TW); Stephen Ronald Smilovitz, Belmont, CA (US)

(73) Assignee: Fitbit, Inc., San Francisco, CA (US)

( * ) Notice: Subject to any disclaimer, the term of this patent is extended or adjusted under 35 U.S.C. 154(b) by 75 days.

(21) Appl. No.: 15/985,853

(22) Filed: May 22, 2018

(65) Prior Publication Data

US 2019/0361402 A1 Nov. 28, 2019

(51) Int. Cl.
*G04B 37/14* (2006.01)
*A44C 5/14* (2006.01)

(52) U.S. Cl.
CPC ..... *G04B 37/1486* (2013.01); *A44C 5/145* (2013.01)

(58) Field of Classification Search
CPC ..... G04B 37/1486; A44C 5/145; A44C 5/14; A44C 5/0007; A44C 5/10; A44C 5/20
See application file for complete search history.

(56) References Cited

U.S. PATENT DOCUMENTS 2,443,805 A 6/1948 Segal
3,165,884 A 1/1965 Gwinner et al.
4,217,681 A 8/1980 Grohoski et al.
4,231,502 A * 11/1980 Meyerson ..... A44C 5/14 224/177
6,935,774 B2 * 8/2005 Fujii ..... G04B 37/082 148/528
8,727,189 B2 5/2014 Zieman et al.
9,014,790 B2 * 4/2015 Richards ..... A61B 5/02438 600/473
9,042,971 B2 * 5/2015 Brumback ..... A61B 5/02438 600/509
9,168,419 B2 * 10/2015 Hong ..... A63B 71/06
9,307,917 B2 * 4/2016 Hong ..... A61B 5/02427
9,402,552 B2 * 8/2016 Richards ..... A61B 5/02427
9,543,636 B2 * 1/2017 Baringer ..... H01Q 21/28
9,572,533 B2 * 2/2017 Venkatraman ..... A61B 5/0205
9,599,632 B2 * 3/2017 Yuen ..... G01B 21/16
9,603,524 B2 * 3/2017 Park ..... A61B 5/0205
9,641,239 B2 * 5/2017 Panther ..... A61B 5/0002
10,004,406 B2 * 6/2018 Yuen ..... A61B 5/0205
10,058,149 B1 8/2018 Wittenberg et al.
(Continued)

FOREIGN PATENT DOCUMENTS

CN 207754685 8/2018

OTHER PUBLICATIONS

"Lumina Handlebar Clamp Mount," NiteRider Technical Lighting, 7 pgs. Downloaded May 17, 2018. <https://www.niterider.com/product/lumina-handlebar-clamp-mount/>.
(Continued)

*Primary Examiner* — Robert Sandy
*Assistant Examiner* — Louis A Mercado
(74) *Attorney, Agent, or Firm* — Weaver Austin Villeneuve & Sampson LLP

(57) ABSTRACT

A low-profile band latch mechanism that is configured to connect a wristband to a fitness tracker or other wrist-wearable device is provided.

20 Claims, 13 Drawing Sheets

(56) References Cited

U.S. PATENT DOCUMENTS

| | | | | |
|---|---|---|---|---|
| 10,136,543 | B1 * | 11/2018 | Nadkarni | H05K 7/1427 |
| 10,178,894 | B2 * | 1/2019 | Vandenbussche | A44B 11/24 |
| 10,219,591 | B2 | 3/2019 | Hatanaka et al. | |
| 10,327,520 | B1 * | 6/2019 | Ely | A44C 5/14 |
| 10,418,693 | B2 * | 9/2019 | Xu | A44C 5/0053 |
| 10,646,007 | B2 | 5/2020 | McCray et al. | |
| 2005/0265132 | A1 | 12/2005 | Ho | |
| 2006/0044201 | A1 | 3/2006 | Arnold et al. | |
| 2007/0064542 | A1 * | 3/2007 | Fukushima | G04B 37/1486 368/282 |
| 2015/0212541 | A1 | 7/2015 | Lu et al. | |
| 2015/0255871 | A1 | 9/2015 | Baringer | |
| 2015/0364813 | A1 | 12/2015 | Darnell et al. | |
| 2016/0037877 | A1 | 2/2016 | Perkins et al. | |
| 2016/0037897 | A1 | 2/2016 | Bataillou et al. | |
| 2016/0056533 | A1 | 2/2016 | Nissinen et al. | |
| 2016/0064280 | A1 | 3/2016 | Ookita et al. | |
| 2017/0181510 | A1 | 6/2017 | Novak | |
| 2017/0187096 | A1 | 6/2017 | Hwang et al. | |
| 2018/0011448 | A1 | 1/2018 | Von Allmen | |
| 2018/0090890 | A1 * | 3/2018 | Kallman | H01R 13/18 |
| 2018/0289115 | A1 | 10/2018 | McCray et al. | |
| 2018/0289116 | A1 | 10/2018 | McCray et al. | |
| 2018/0294554 | A1 | 10/2018 | Xu et al. | |
| 2019/0174882 | A1 * | 6/2019 | Cuenat | G04B 37/1486 |
| 2020/0014098 | A1 | 1/2020 | Xu et al. | |
| 2020/0154835 | A1 | 5/2020 | Chen | |

OTHER PUBLICATIONS

"Lumina Helmet Mount," NiteRider Technical Lighting, 7 pgs. Downloaded May 17, 2018. <https://www.niterider.com/product/lumina-helmet-mount/>.

"GoPro Adapter by K-Edge," NiteRider Technical Lighting, 8 pgs. Downloaded May 17, 2018. <https://www.niterider.com/product/gopro-adapter>.

U.S. Notice of Allowance dated Jan. 15, 2020, in U.S. Appl. No. 15/627,915.

U.S. Office Action dated Jan. 2, 2019, in U.S. Appl. No. 15/820,928.

U.S. Notice of Allowance dated May 8, 2019, in U.S. Appl. No. 15/820,928.

U.S. Office Action dated Feb. 20, 2020, in U.S. Appl. No. 16/571,482.

U.S. Notice of Allowance dated Jun. 12, 2020, in U.S. Appl. No. 16/571,482.

Chinese Office Action dated Apr. 10, 2018, for Chinese Patent Application No. 201721357976.X, filed Oct. 20, 2017.

"40mm Black Sport Band—Regular," Apple. 3 pgs. Downloaded Jul. 10, 2020. <https://www.apple.com/shop/product/MTP62AM/A/40mm-black-sport-band-regular?afid=p238%7CsxTBcV4Rt-dc_mtid_1870765e38482_pcrid_349060169746_pgrid_68474163257_&cid=aos-us-kwgo-pla---slid---product-MTP62AM/A>.

"Galazy Fit, Silver," Samsung. 22 pgs. Downloaded Jul. 10, 2020. <https://www.samsung.com/us/mobile/wearables/smart-fitness-bands/samsung-galaxy-fit-sm-r370nzsaxar>.

U.S. Appl. No. 16/848,322, filed Apr. 14, 2020, Riot et al.

U.S. Appl. No. 16/855,976, filed Apr. 22, 2020, Riot et al.

U.S. Office Action dated Jun. 10, 2020, in U.S. Appl. No. 16/848,322.

* cited by examiner

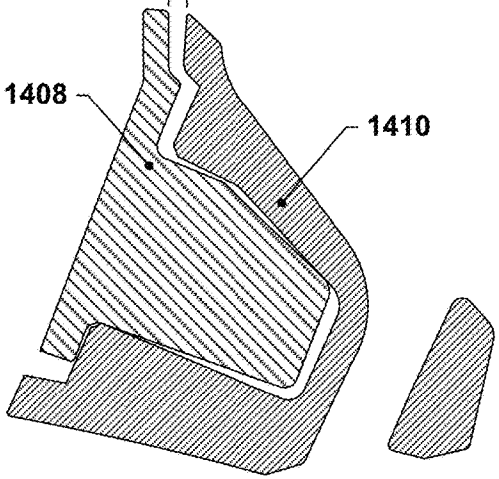
Figure 14
Figure 15
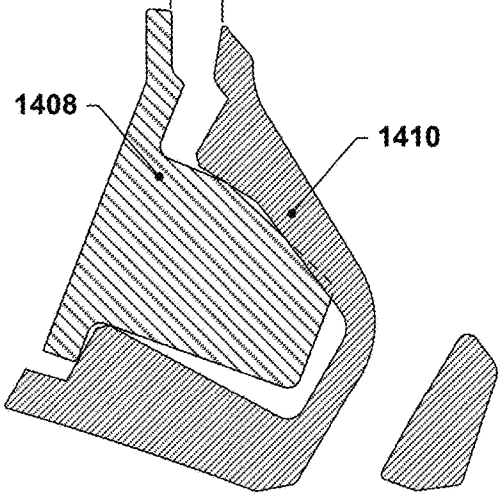
Figure 16
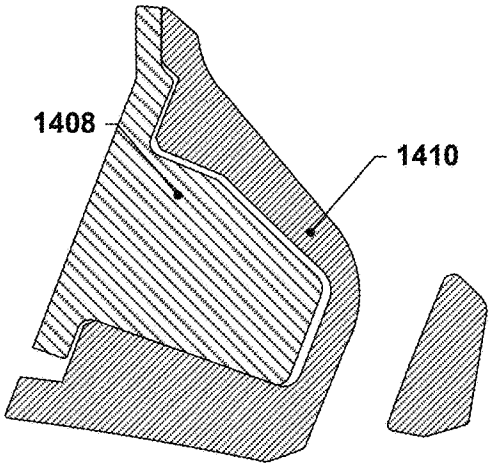
Figure 17
Figure 18

LOW-PROFILE BAND LATCH MECHANISM

BACKGROUND

Wearable devices, such as watches or personal fitness and health monitoring devices, which may be referred to as biometric monitoring devices or fitness trackers herein, may be worn by a user on various locations on the user's body, such as around the user's wrist. Wristband straps may be attached to a housing of such wearable devices, wrapped around the user's wrist, and joined together to form a loop that may appear to be a bracelet or wristband. Conventional wrist straps for watches typically feature a strap with a transverse hole at the end that connects with the watch body; a spring-loaded pin (much like that used for toilet paper dispensers) may then be threaded through the hole, compressed, and allowed to expand into holes on facing surfaces of the watch body.

SUMMARY

Details of one or more implementations of the subject matter described in this specification are set forth in the accompanying drawings and the description below. Other features, aspects, and advantages will become apparent from the description, the drawings, and the claims.

In some implementations, an apparatus may be provided that includes a receptacle portion for a strap of a wrist-wearable device, the receptacle portion including: a first mating surface configured to butt up against a corresponding second mating surface of an insertion portion with which the receptacle portion is configured to connect and a receptacle having a first root surface, a first end surface, and a first base surface. In such an implementation, the first root surface may face towards the first base surface, the first base surface may face towards the first root surface, and the first root surface and the first base surface may be interposed between the first mating surface and the first end surface. Such implementations may also include one or more anti-rotation features and one or more recesses in the first base surface. At least one of the one or more anti-rotation features may protrude from the first end surface towards the first mating surface, and the at least one of the one or more anti-rotation features may each have a corresponding first contact surface that faces towards the first base surface and is separated from the first base surface by a first gap.

In some implementations, the apparatus may further include a first sloped surface. In such implementations, the first sloped surface may be interposed between the first end surface and the first root surface, the first sloped surface may face towards the first root surface, and the first sloped surface may form an angle with the first base surface such that a distance between the first sloped surface and the first base surface as measured along a direction perpendicular to the first base surface increases with increasing distance from the first end surface.

In some implementations, the receptacle portion may include an injection-molded insert made from a material selected from the group consisting of: metal and rigid plastic, and the apparatus further includes a strap that is overmolded onto the receptacle portion, thereby embedding the insert into the strap.

In some such implementations, the strap may have an exterior surface in a portion of the strap that overmolds the receptacle portion, the exterior surface may have an edge that is configured to be adjacent to the insertion portion when the receptacle portion is connected with the insertion portion, the edge may be nominally parallel to the first base surface and the first end surface, the exterior surface may be sloped such that a distance between the exterior surface and the first base surface along a first axis normal to the first base surface decreases with increasing distance between the first axis and the edge, and the exterior surface may form an angle of between 20° and 25° with the first base surface. In some additional such implementations, the exterior surface and the first mating surface may form an angle of between 60° and 70°.

In some implementations of the apparatus, the receptacle portion may further include: a) a strap bar extending in a direction transverse to the first end surface, b) a main body that houses the receptacle, and c) at least one support leg. In such implementations, the strap bar may be offset from the main body by a second gap to permit a strap to pass through the second gap and between the main body and the strap bar, and each support leg may span between the strap bar and the main body.

In some implementations of the apparatus, there may be a plurality of recesses in the first base surface, the recesses may be arranged in a linear array along an axis that is nominally parallel to the first end surface and the first base surface, and each recess may be spaced apart from any neighboring recess or recesses by a first distance.

In some implementations of the apparatus, there may be a plurality of anti-rotation features that are spaced apart from one another along an axis that is nominally parallel to the first end surface and the first base surface.

In some implementations of the apparatus, each of the at least one anti-rotation feature of the one or more anti-rotation features may be a peninsula that extends towards the first base surface from a surface selected such as the first root surface or a surface spanning between the first root surface and the first end surface.

In some implementations of the apparatus, each of the at least one of the one or more anti-rotation features may have a cross-section when viewed along an axis normal to the first end surface, and the cross-section may be a U-shaped cross-section, a circular cross-section, a square cross-section, a rectangular cross-section, a trapezoidal cross-section, a regular polygon cross-section, or an obround cross-section.

In some implementations of the apparatus, each of the at least one of the one or more anti-rotation features may be a mesa that protrudes from the first end surface without contacting other surfaces defining the receptacle.

In some implementations of the apparatus, the first contact surface of each of the at least one of the one or more anti-rotation features may be nominally semi-cylindrical.

In some implementations of the apparatus, the receptacle portion may further include a channel extending from an exterior surface of the receptacle portion to the first base surface, the channel may include a floor surface that is nominally parallel to the first end surface and that is interposed between the first mating surface and the first end surface, the channel may extend up to the first mating surface, and the one or more recesses may be interposed between the channel and the first end surface.

In some implementations of the apparatus, the apparatus may further include the insertion portion, and the insertion portion may include a protrusion with a second base surface, a second root surface, and a second end surface. In such implementations, the second root surface may face away from the second base surface, the second base surface may face away from the second root surface, and the second base surface, the second end surface, and the second root surface may be complements of the first base surface, the first end surface, and the first root surface, respectively. The protrusion may also include a corresponding anti-rotation recess for each of the at least one of the one or more anti-rotation features of the receptacle portion, each anti-rotation recess may extend into the second end surface and has a second contact surface facing away from the second base surface, and the second contact surface may be a complement of the first contact surface and may be configured to contact the first contact surface when the protrusion is fully inserted into the receptacle.

In some implementations, the insertion portion may further include a button and a spring, the button may have one or more teeth, and each tooth may correspond with a recess of the one or more recesses in the first base surface. In such implementations, the button may be configured to translate along a translation axis that is nominally perpendicular to the second base surface, the spring may be configured to press the button against the first base surface when the protrusion is fully inserted into the receptacle, and each tooth may be positioned so as to protrude into the corresponding recess when the protrusion is fully inserted into the receptacle and the button is pressed against the first base surface.

In some such implementations, the insertion portion may further include a guide and a spring stop in which the guide is configured to substantially limit movement of the button to translation along the translation axis, the spring stop is located at one end of the guide, and the spring is interposed between the button and the spring stop.

In some further implementations, the apparatus may also include a housing of the wrist-wearable device, and the guide and the spring stop may be features on the housing. In some such implementations, the protrusion may be provided, at least in part, by a separate component that is attached to the housing, the separate component may include one or more button stops configured to engage with surfaces of the button to limit travel of the button away from the spring stop to a first distance, the spring may be configured to press the button against the one or more button stops when the button is otherwise unloaded, and the button may have a surface that is flush with a surface of the housing when the button is positioned at the first distance away from the spring stop.

In some implementations, the apparatus may further include a metal housing of the wrist-wearable device and a cover glass of the wrist-wearable device. In such implementations, the insertion portion may be adjacent to the metal housing and the cover glass, the metal housing may include a display unit, the cover glass may cover the display unit, and the insertion portion may include a plastic rim lip that is interposed between a) the cover glass and at least a portion of the metal housing and b) the first mating surface when the protrusion is fully inserted into the receptacle.

In some implementations, a wearable device strap kit may be provided, with the kit including two of implementations of an apparatus as described earlier, with one such implementation being connected with a first end of a first strap and the other implementation connected with a first end of a second strap. In such an implementation, a second end of the first strap opposite the first end of the first strap may include one or more features that are configured to adjustably secure the second end of the first strap to the second strap.

In some implementations, an apparatus may be provided that includes an insertion portion for a wrist-wearable device in which the insertion portion may include: a first mating surface configured to butt up against a corresponding second mating surface of a receptacle portion with which the insertion portion is configured to connect. The insertion portion may also include a protrusion with a first base surface, a first root surface, and a first end surface, and the first root surface may face away from the first base surface. The first base surface may also face away from the first root surface, and the first root surface and the first base surface may be interposed between the first mating surface and the first end surface. The protrusion may also include one or more anti-rotation recesses, and at least one of the one or more anti-rotation recesses may extend into the first end surface and has a first contact surface facing away from the first base surface.

BRIEF DESCRIPTION OF THE DRAWINGS

The various implementations disclosed herein are illustrated by way of example, and not by way of limitation, in the figures of the accompanying drawings, in which like reference numerals refer to similar elements.

FIGS. 14 through 16 depict simplified section slices of an example insertion portion and receptacle portion of an example low-profile band latch mechanism in various states of relative rotation.

FIGS. 17 and 18 depict simplified section slices of another example insertion portion and receptacle portion of another example low-profile band latch mechanism in various states of relative rotation.

FIGS. 1 through 18 are drawn to-scale within each Figure, although not necessarily to the same scale from Figure to Figure.

DETAILED DESCRIPTION

Figure 1:
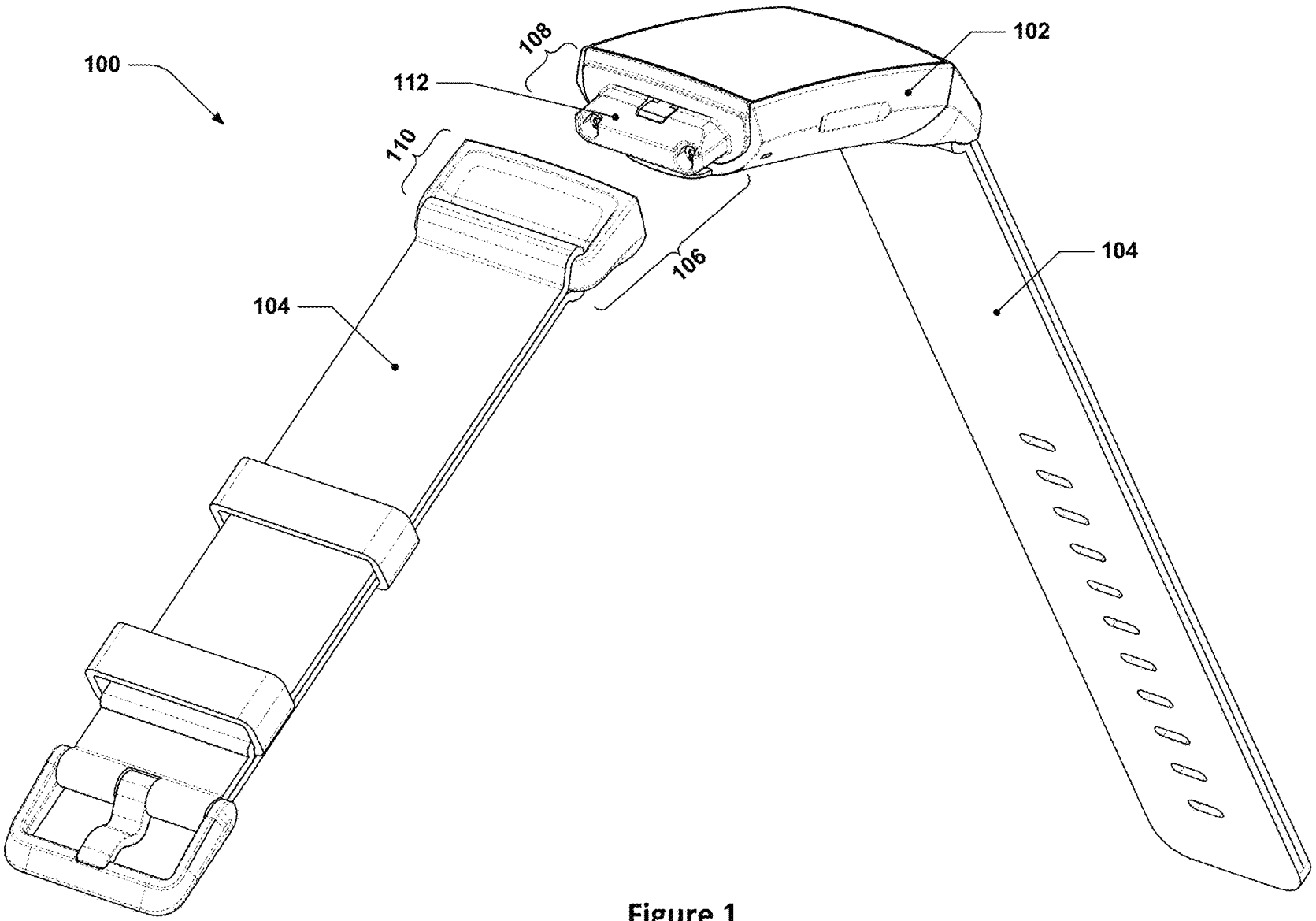
FIG. 1 is a perspective view of an example wrist-wearable device with an example low-profile band latch mechanism; one strap is detached to show the example mechanism.

Importantly, the concepts discussed herein are not limited to any single aspect or implementation discussed herein, nor to any combinations and/or permutations of such aspects and/or implementations. Moreover, each of the aspects of the present invention, and/or implementations thereof, may be employed alone or in combination with one or more of the other aspects and/or implementations thereof. For the sake of brevity, many of those permutations and combinations will not be discussed and/or illustrated separately herein.

Biometric monitoring devices, also referred to as fitness trackers, are generally worn on a user's body, such as around the user's wrist or ankle. Many fitness trackers include a housing that houses electronics for monitoring various health-related parameters, including, but not limited to, steps taken, calories burned, etc., as well as for transmitting data relating to such monitored parameters. For those fitness trackers worn around a user's wrist, they may include a wristband that attaches to the housing and is used to secure the fitness tracker around the user's wrist. The wristband may include two wristband straps that are flexible to allow the ends of the wristband straps to be joined together using a buckle component (or other fastening mechanism) to form a loop. When the ends of the wristband straps are joined together, the fitness trackers may appear to be a bracelet or wristband. The housings of such fitness trackers may have identical (or nearly identical) interfaces on each end that may receive features from a wristband strap which enable the wristband strap to be connected to the housing and also be removable from the housing so that replacement wristbands or wristbands of different sizes or styles may be exchanged and connected to the housing.

The disclosure herein includes a low-profile band latch mechanism that may be used for connecting a wristband strap to a housing of a fitness tracker. It will be understood that similar low-profile band latch mechanisms may also be used for non-fitness tracker wrist-wearable applications, such as on ordinary watches or other wrist-wearable devices.

In contrast to existing band attachment mechanisms, the low-profile band latch mechanisms discussed herein provide mechanisms for attaching the bands or straps of a wrist-wearable device by simply sliding the straps onto the ends of the wrist-wearable device housing along directions that are "in-line" or aligned with the straps. Put another way, the low-profile band latch mechanisms discussed herein connect simply by virtue of butting the ends of the straps up against the ends of the housing to which they connect, without requiring lateral motion (transverse to the straps) or vertical motion (along the thickness direction of the straps). More particularly, such designs may include all of the moving parts on the portion of the attachment mechanism that is located on the wrist-wearable device housing, as opposed to locating such parts in the straps. This greatly simplifies the design and manufacture of the straps—requiring, in some implementations, only one or two discrete components to provide the low-profile band latch mechanism portion for a strap or band. As there will typically be far more strap/band sets manufactured than device housings (because a user may frequently purchase additional strap sets to provide for more varied fashion choices or to replace broken or worn-out straps), simplifying the design of the portion of the attachment mechanism that is in the straps may significantly reduce manufacturing costs.

For the sake of comparison, the Apple Watch has interchangeable watch straps that slide transversely into C-shaped grooves or channels located on ends of the watch housing. This requires the user to line up the ends of the straps with the channel/groove, which can prove difficult to do since the ends of the straps and the channels/grooves are machined to very tight tolerances to avoid a loose fit. Furthermore, the user must then slide the strap transversely into the housing for the full width of the strap.

Various aspects of some example low-profile band latch mechanisms are discussed below with respect to the drawings of the present disclosure, although it will be understood that these are merely examples provided with the aim of understanding the concepts discussed herein and should not be viewed as limiting the scope of the disclosure to only the specific implementations discussed herein.

FIG. 1 is a perspective view of an example wrist-wearable device with an example low-profile band latch mechanism; one strap is detached to show the example mechanism. In FIG. 1, an example wrist-wearable device 100 is shown that includes a capsule 102 that may house electronic components, such as a battery, display, one or more sensors, one or more communications interfaces, one or more processors, etc. The example wrist-wearable device 100 may also include a pair of straps 104 that may be attached to the capsule 102 by way of a low-profile band latch mechanism 106. The low-profile band latch mechanism 106 may include an insertion portion 108 having a protrusion 112 and a receptacle portion 110 that receives the protrusion 112. Further details of this implementation are discussed in following Figures.

Figure 2:
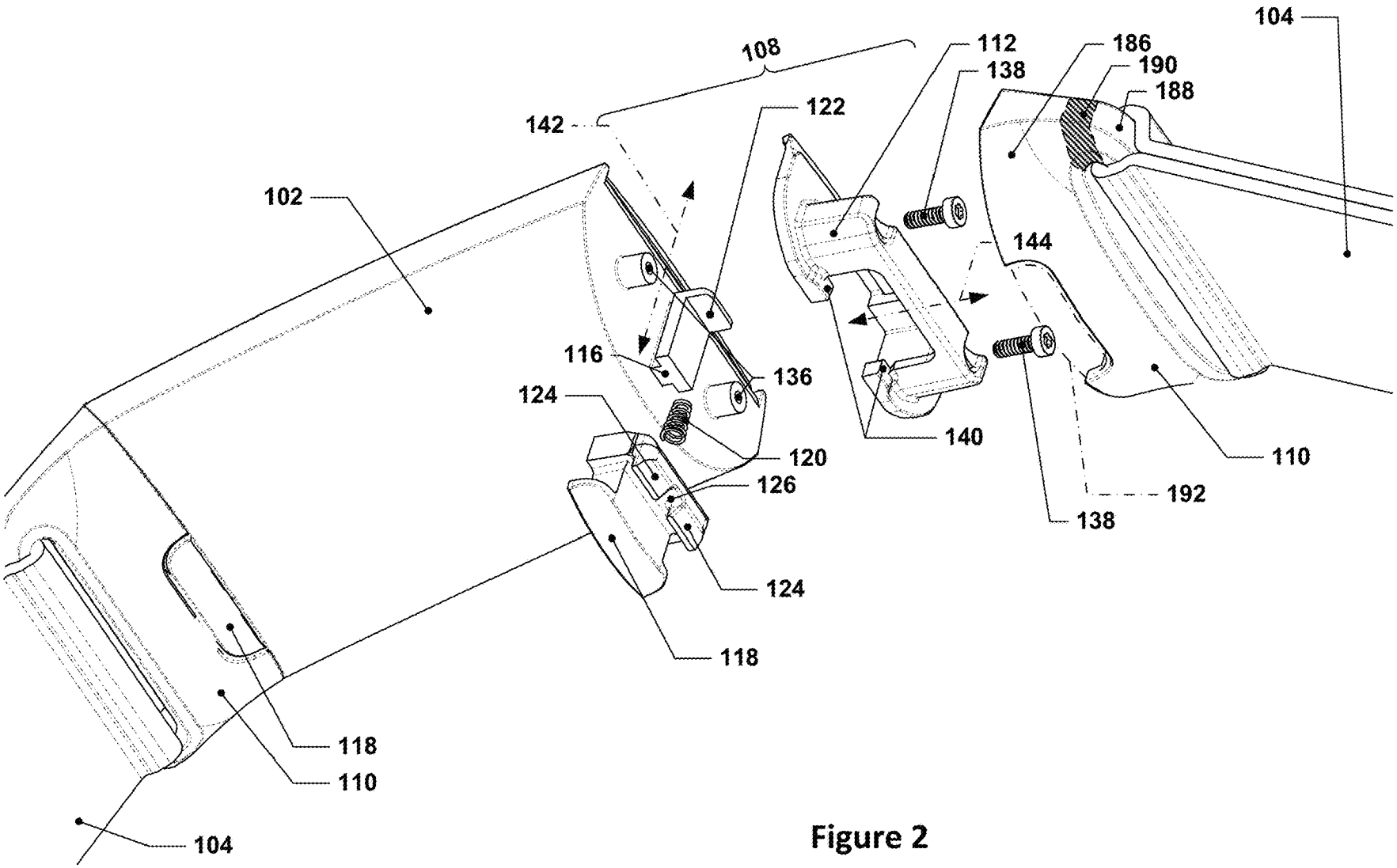
FIG. 2 depicts a partial exploded view of the example wrist-wearable device of FIG. 1.

FIG. 2 depicts a partial exploded view of the example wrist-wearable device of FIG. 1. As can be seen, the capsule 102 has two insertion portions 108, one at either end (the left one is hidden from view, having been inserted into the left strap 104) and each with a button 118 on the underside that has an exposed surface that is flush with the contours of the capsule 102 and the receptacle portion 110 adjacent to that button 118. In some implementations, the exposed button surface may be proud of the contours of the capsule 102, although this may run the risk of accidental button activation since the button surface may then press on the person's wrist when the wrist-wearable device is worn. While a flush implementation may be aesthetically pleasing and may significantly reduce the possibility of accidental button activation, some implementations may feature an exterior button surface that is slightly sub-flush from the contours of the capsule 102, e.g., recessed by 0.1 mm or between 0.1 and 0.5 mm, in order to further reduce the chances of this happening. Each button 118 includes, for example, one or more teeth 124—if multiple teeth 124 are provided, then they may be separated from one another by a gap 126. The buttons 118 may each be configured to engage with, and slide along, a guide 116 so as to have their motion primarily limited to translation along a translation axis 142. A channel 192 may be provided in the receptacle portion 110 to provide clearance for the translation of the button 118 along the translation axis 142; such a channel may, in some implementations, have a generally constant cross-section along the translation axis 142. It will be understood that there may be some small amount of translation in directions perpendicular to the translation axis 142 permitted, for example, due to manufacturing tolerances or other minor gaps between components, e.g., to prevent binding or potential binding due to potentially differing amounts of thermal expansion in the guide 116 and the button 118, but the button 118 may nonetheless be generally constrained by the guide 116 to move primarily along the translation axis 142. At the end of the guide 116 is a spring stop 122, which may be used to support one end of a spring 120. In this example, the guide 116 and the spring stop 122 are both integral parts of the capsule 102, although it will be understood that in other implementations, one or both of these features may be provided by a separate component or components that are assembled together to provide similar functionality.

A spring 120 may be provided that is interposed between the button 118 and the spring stop 122; the spring 120 may be configured such that it exerts a restoring force on the button 118 to cause the button 118 to be biased to move away from the spring stop 122 along the translation axis 142 when the spring 120 is compressed.

A separate component including the protrusion 112 may fasten over the button 118, thereby trapping the button 118 against the side of the capsule 102 that has the guide 116. In this example, the separate component may also include button stops 140 that may engage with surfaces of the button 118 after the button 118 has translated far enough away from the spring stop 122 to prevent the button 118 from translating away from the spring stop 122 by more than a first amount. Such button stops 140 may, in other implementations, be part of the capsule 102 or part of a separate component. For example, in some implementations, the spring stop 122 may be located on the separate component with the protrusion 112 and the button stops 140 may be located on the housing of the capsule 102. In effect, the button 118 is limited in its translation along the translation axis 142 in one direction by contact between the button 118 and the interior surfaces of the protrusion 112 or by the spring stop 122 and the maximally compressed state of the spring 120 and in the other direction by the button stops 140. In some implementations, the buttons 118 may have exterior-facing surfaces that match the contours of the housing of the capsule 102 and the receptacle portions 110 adjacent to the locations of the buttons 118 and the button stops 140 may cause the button 118 to stop translating such that the exterior-facing surfaces of the buttons 118 are flush with the adjacent surfaces of the housing of the capsule 102 and the receptacle portions 110. In such implementations, the overall contour of the underside of the wrist-wearable device may be unbroken by any holes, divots, recesses, etc. attributable to the low-profile band latch mechanism—the only evidence of the existence of the buttons 118 may, in such cases, be the seams between the buttons 118 and the adjacent components. Such seams may, for example, be only a few thousandths of an inch wide.

In the depicted example low-profile band latch mechanism, the protrusion 112 is provided by a separate component that is affixed to the housing of the capsule 102 by way of screws 138 and threaded interfaces 136. As discussed earlier, the insertion portions and the receptacle portions of the low-profile band latch mechanisms discussed herein may be connected with each other by simply sliding the insertion portion into the receptacle portion (and/or sliding the receptacle portion over the insertion portion) along a direction that is "in-line" or aligned with the straps, e.g., along insertion axis 144. Such motion has the effect of butting the receptacle portion 110 up against the insertion portion 108. This makes attaching the straps 104 to the capsule 102 extremely easy, requires little or no effort, and involves only a relatively small amount of actual relative displacement between the receptacle portion 110 and the insertion portion 108.

The receptacle portions 110 shown in FIG. 2 are intended to be used with leather or woven/textile straps and thus feature a main body 186 that is coupled with a strap bar 188 that is offset from the main body by a gap 134 (see FIG. 3) and supported relative to the main body by a pair of support legs 190. In variants of such implementations, the strap bar 188 may be a removable component, e.g., a traditional spring-loaded watch pin. Other implementations, such as the single-piece injection-molded variants discussed later herein, are also considered to be within the scope of this disclosure.

Figure 3:
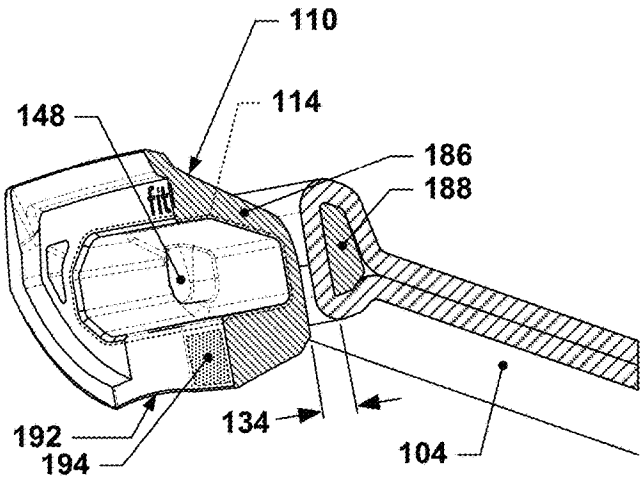
FIG. 3 depicts a perspective section view of the example wrist-wearable device of FIG. 1.
Figure 3:
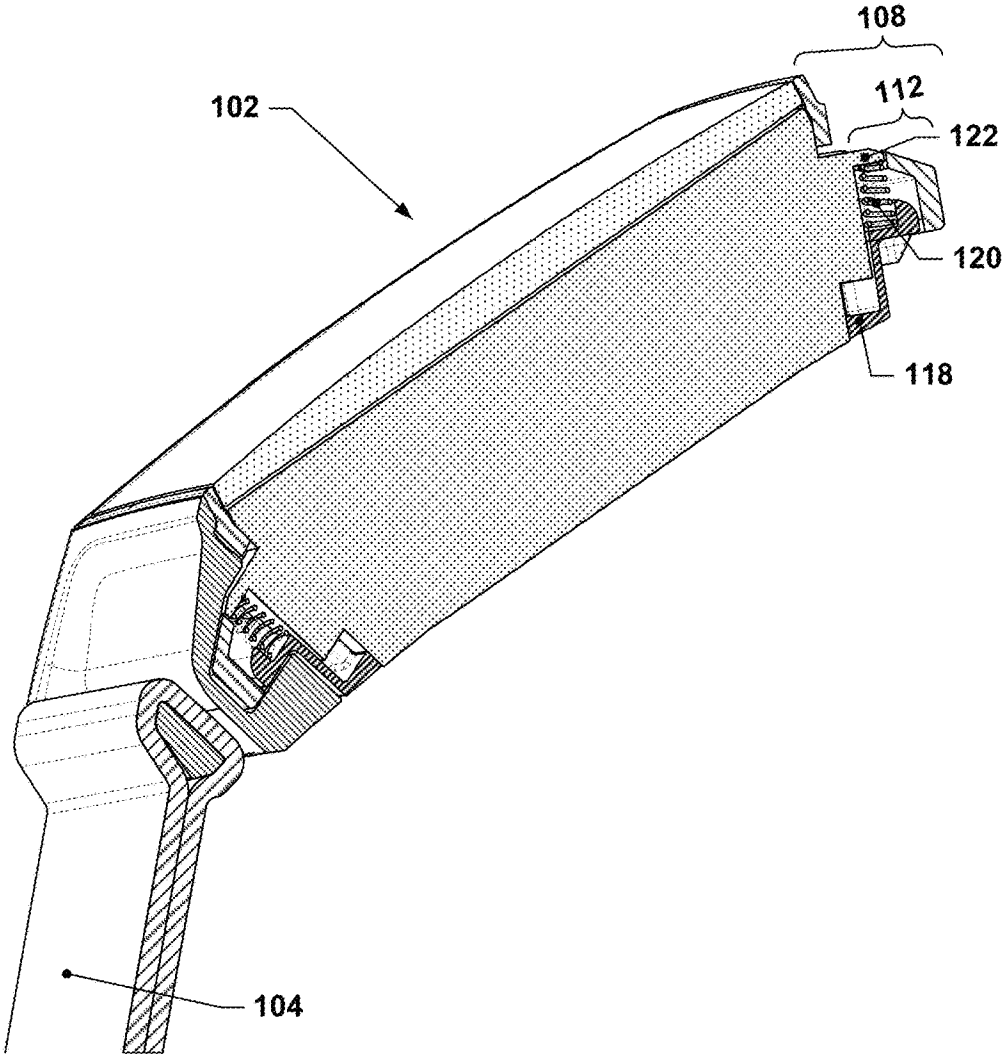

FIG. 3 depicts a perspective section view of the example wrist-wearable device of FIG. 1. While FIG. 2 depicted various details of the insertion portion 108, FIG. 3 depicts details of the receptacle portion 110, such as receptacle 114, in which an anti-rotation feature 148 may be seen. It will be understood that FIG. 3 is a section/cutaway view to allow for more clear depiction of features in the receptacle 114; the cut-away portion is generally a mirror image of the depicted portion (the Fitbit logo, for example, would not be mirrored on the other side). Various subportions of the receptacle 114 and the anti-rotation feature 148 are discussed in more depth in later Figures, although it will be noted that the receptacle portion 110 is generally free of complicated structures or mechanisms, consistent with the discussion earlier of the beneficial aspects of the receptacle portion 110.

FIG. 3 also shows the insertion portion 108 in its assembled state, with the spring 120 trapped between the button 118 and the spring stop 122, with the protrusion 112 that is insertable into the receptacle 114 clearly evident. Also visible in more detail is the channel 192 and a floor surface 194 of the channel 192.

Further discussion of the example low-profile band latch mechanism of FIG. 1 is provided below with respect to various cross-sectional Figures for greater clarity.

Figure 4:
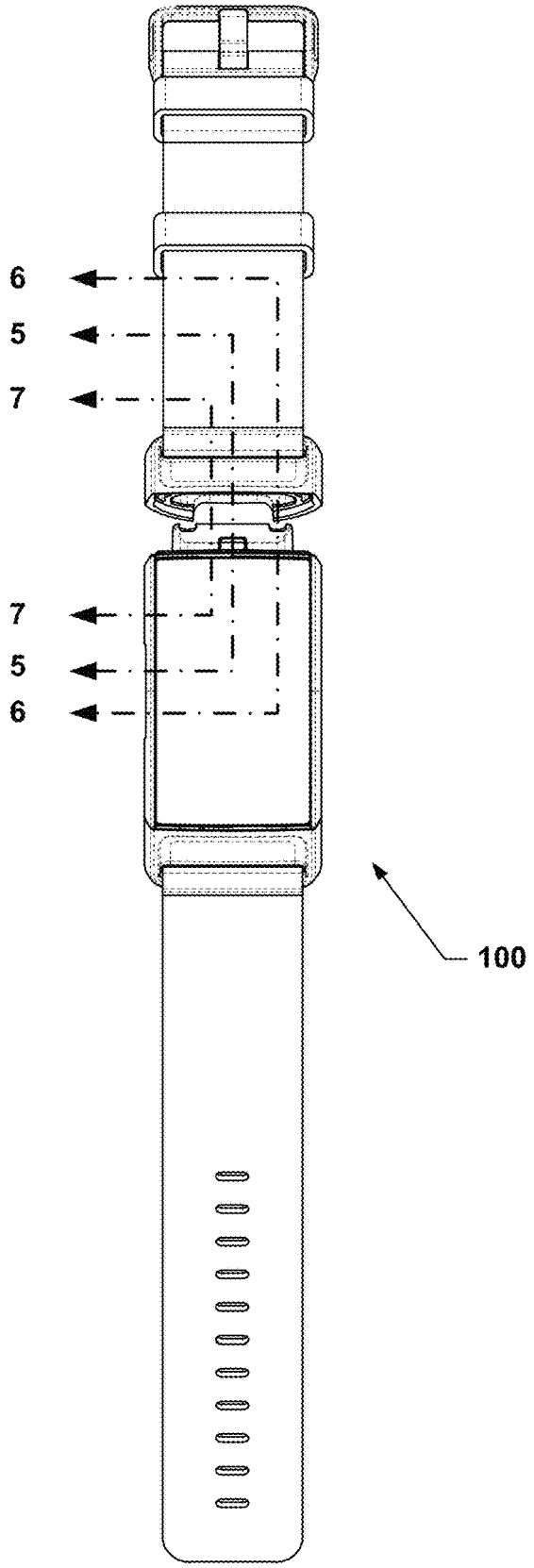
FIG. 4 depicts a top view of the example wrist-wearable device of FIG. 1 with section lines indicating sectioning planes for FIGS. 5 through 10.
Figure 5:
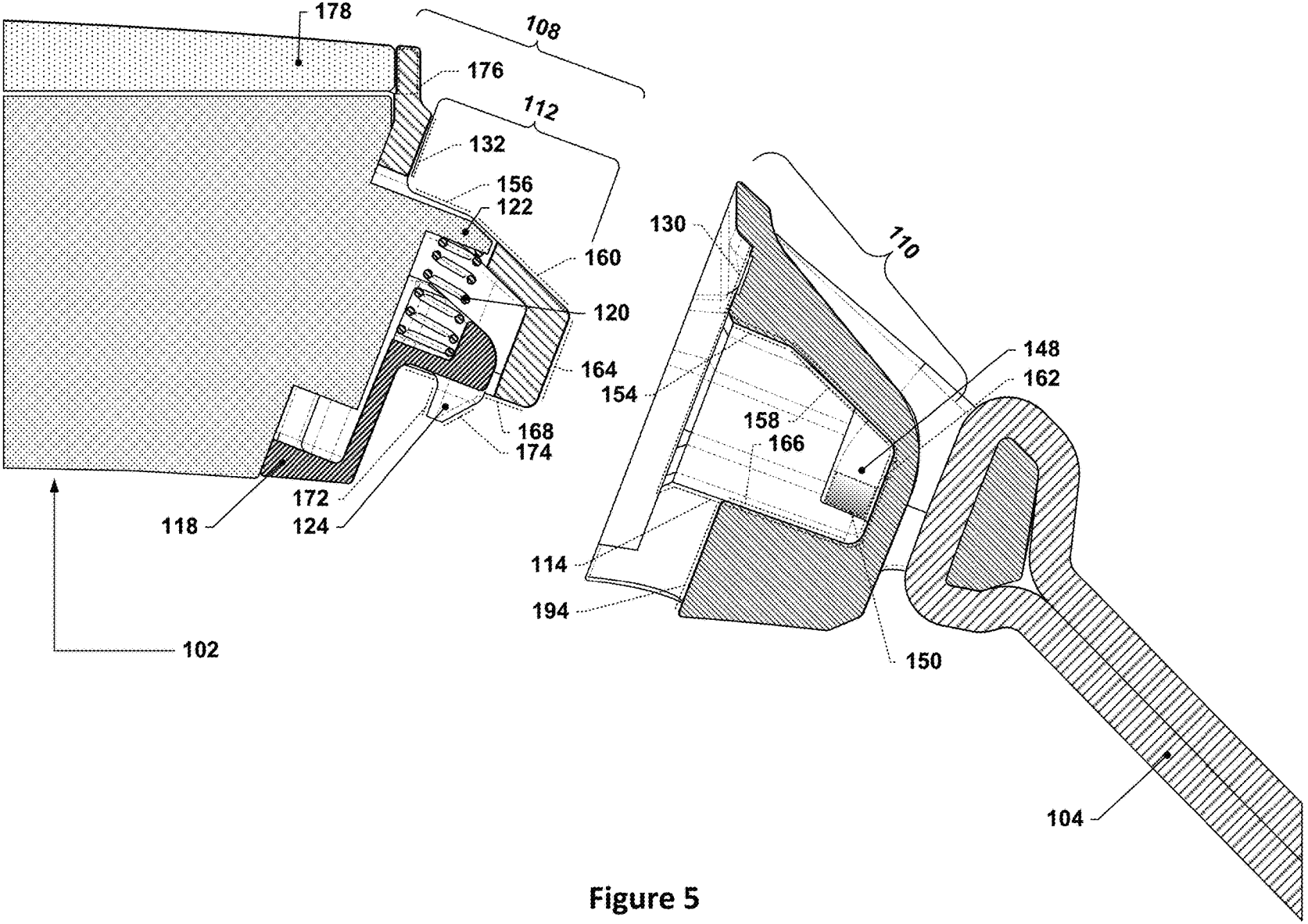
FIGS. 5 through 7 depict detail section views of the example wrist-wearable device of FIG. 1.
Figure 6:
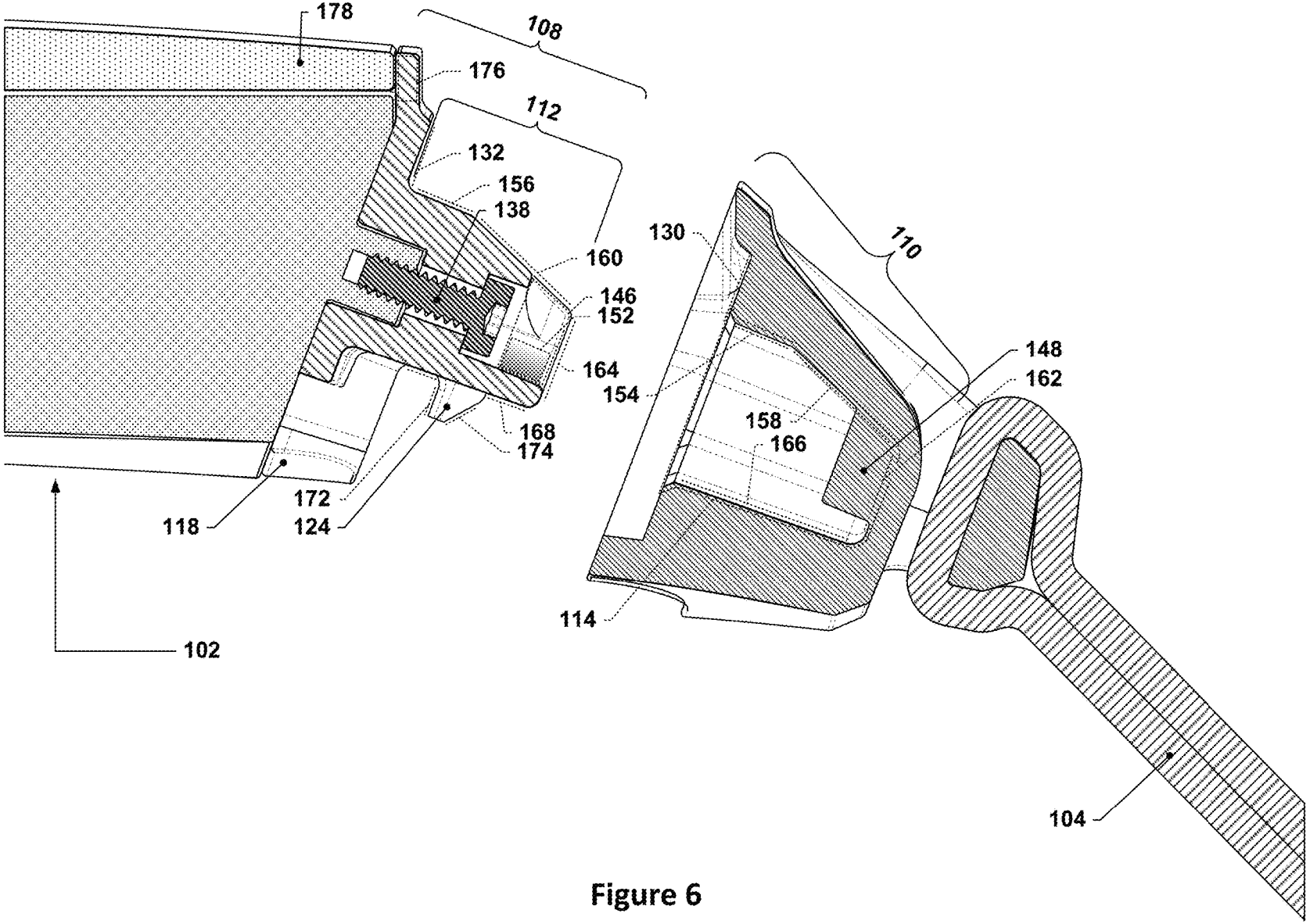
Figure 7:
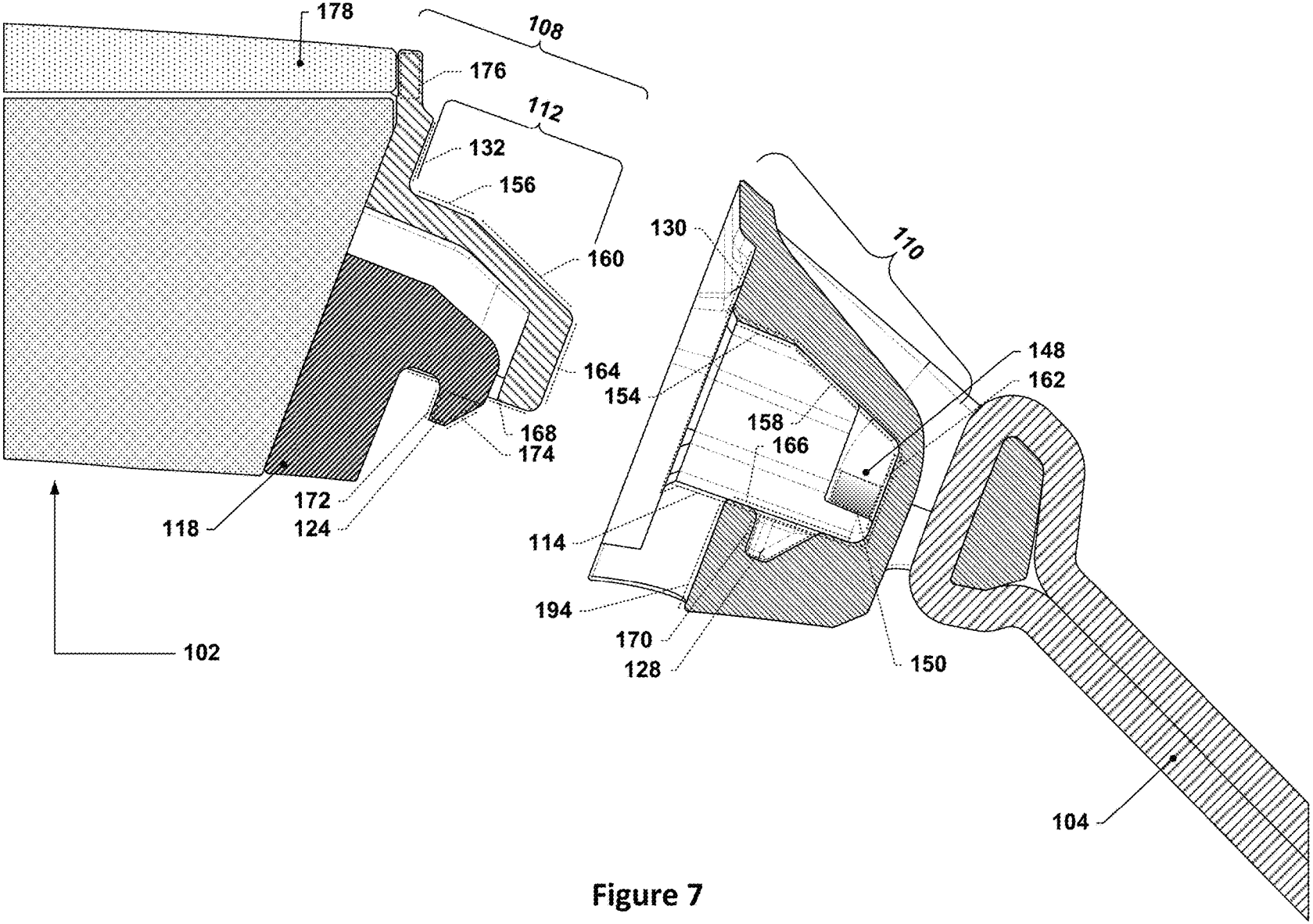
Figure 8:
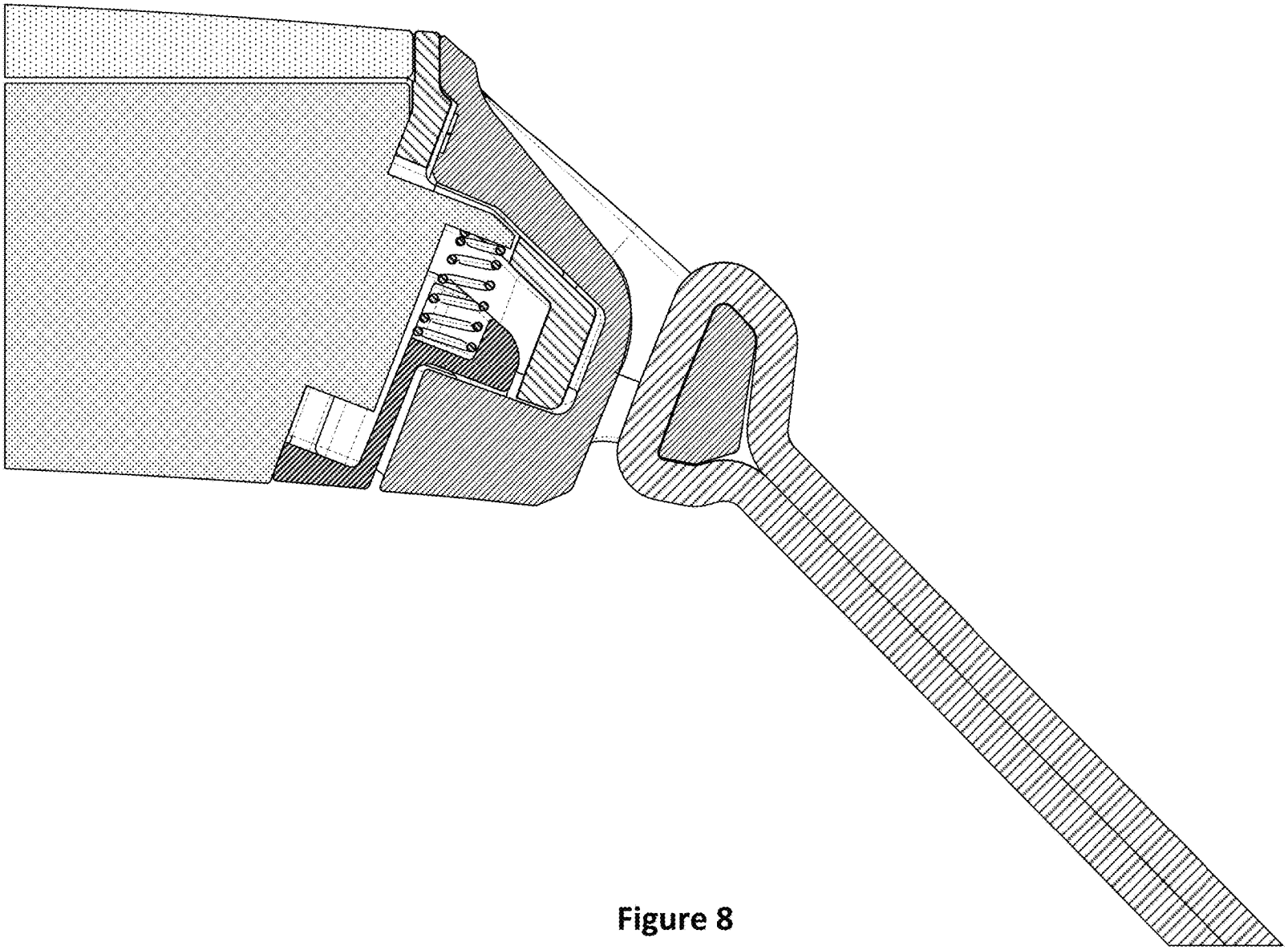
FIGS. 8 through 10 depict detail section views of the example wrist-wearable device of FIG. 1 but with the straps actually attached using the low-profile band latch mechanism.
Figure 9:
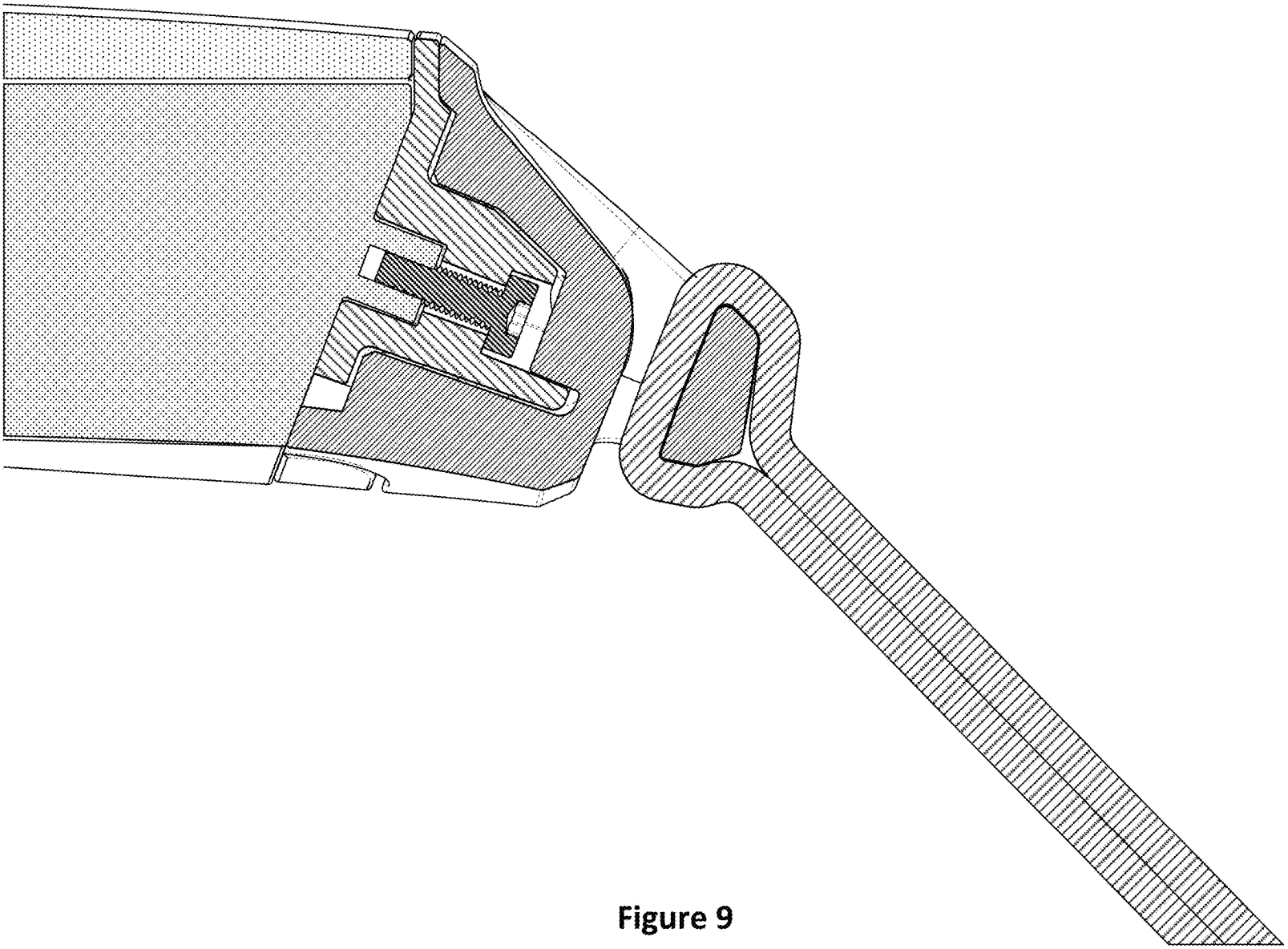
Figure 10:
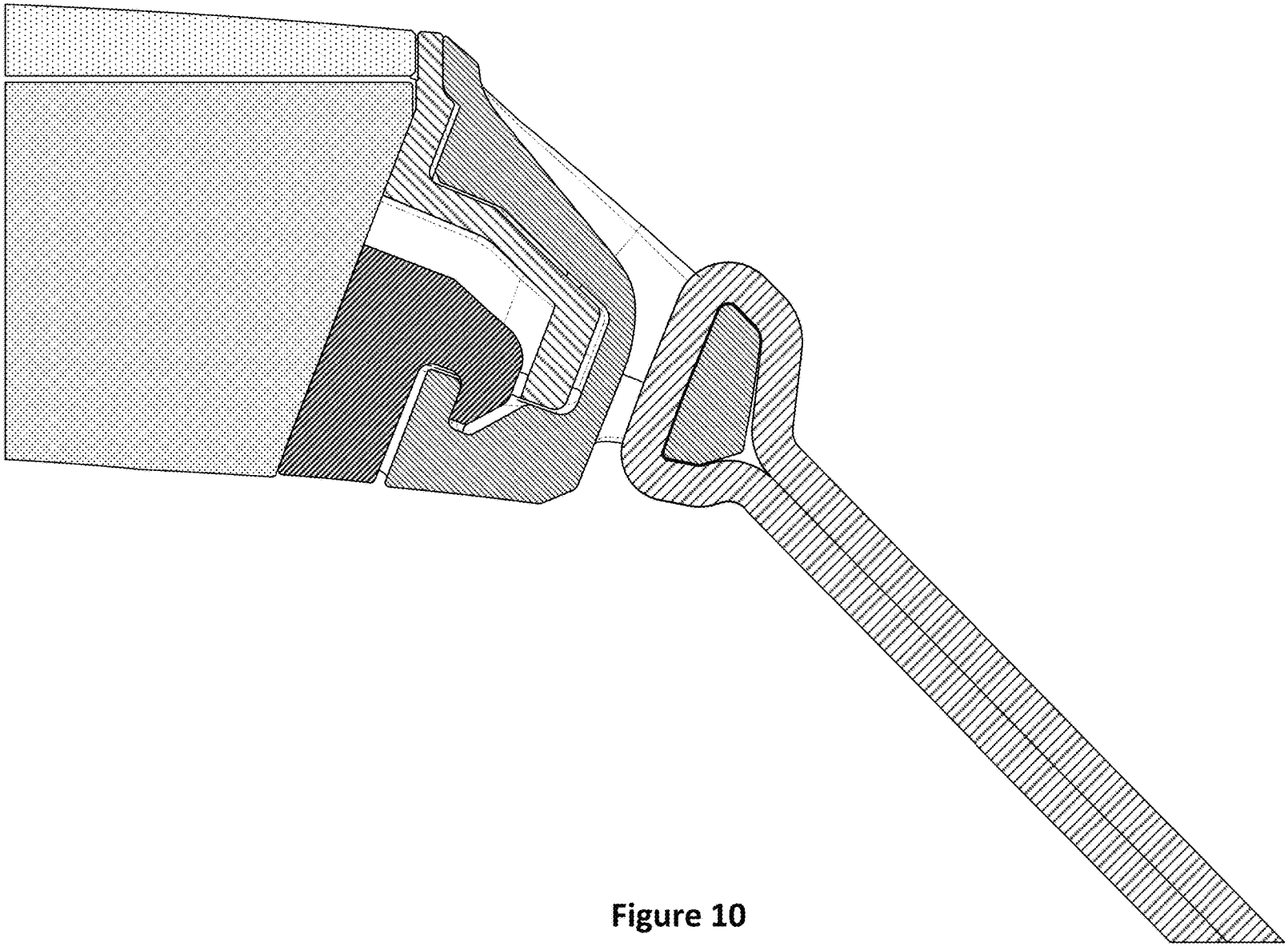

FIG. 4 depicts a top view of the example wrist-wearable device of FIG. 1 with section lines indicating sectioning planes for FIGS. 5 through 10. FIGS. 5 through 7 depict detail section views of the example wrist-wearable device of FIG. 1. FIGS. 8 through 10 depict detail section views of the example wrist-wearable device of FIG. 1 but with the straps actually attached using the low-profile band latch mechanism.

In FIG. 5, the sectioning plane passes through the midplane of the wrist-wearable device 100, bisecting it. The capsule 102 is shown as being solid, although the housing of the capsule 102 is to be understood as being, in actuality, largely hollow and containing various electronic components, e.g., a display, one or more processors, sensors, etc., that may provide functionality for the wrist-wearable device 100. Such detail is largely immaterial to this disclosure and has thus been omitted for the purposes of clarity and brevity.

As is visible in FIG. 5, the capsule 102 has a cover glass 178 that may be a transparent cover for a display housed within the capsule 102 (the cover glass may or may not have silk-screened or otherwise opaque areas for masking non-active areas of the display). In some implementations, the housing of the capsule 102 may be made from a metal, e.g., a machined aluminum or magnesium alloy or machined stainless steel, and the protrusion 112 of the insertion portion 108 may be a separate component made of a plastic material that is attached, e.g., via screws 138, to the housing of the capsule 102. In some such implementations, the separate component may have a rim lip 176 that extends up to the edge of the cover glass 178. The rim lip 176 would thus be interposed between the cover glass 178 and the receptacle portion 110 when the receptacle portion 110 is connected with the insertion portion 108. One benefit to such an arrangement is that the rim lip 176, which may be a relatively thin, e.g., on the order of 0.5 mm to 0.7 mm, e.g., 0.6 mm, may a) help center the cover glass 178 during assembly and b) may protect the cover glass 178 from potential damage if the capsule is ever dropped or otherwise subjected to impact such that the corners or edges of the cover glass 178 are protected from direct impact against a hard surface, e.g., concrete, tile, or metal. In some such implementations, the cover glass may be protected or shielded along the longitudinal edges (those spanning between the two insertion portions 108) by raised metal edges or lips of the housing of the capsule 102 and may be protected or shielded along the transverse edges (those abutting the insertion portions 108) by plastic rim lips 176. It was also contemplated that the housing of the capsule 102 could be machined so as to have a raised metal edge or lip that extended completely around the outer perimeter of the cover glass 178, although it was determined that such a design ran the risk of having the raised metal edge or lip, which would be fairly thin, permanently deform, which could a) act as a continuous stress riser on the cover glass 178 and b) act to transfer impact loads directly into the cover glass 178 with little or no energy absorption. Accordingly, the use of a separate plastic component (which is much more resilient than metal and would be able to recover to its original undeformed shape after most impact loads) with a rim lip 176 may provide advantages over the use of an all-metal rim lip.

As can be seen in FIG. 5, the protrusion 112 may extend outward from the capsule 102. In the specific implementation shown in FIG. 5, the spring stop 122 and the button 118 trap the spring 120 between them; the spring 120, which, in this case, is a tapered spring to allow for a slightly smaller fully compressed height, acts to push the button 118 outwards so that the exterior-facing surface of the button 118 is flush or slightly sub-flush with the exterior surface of the housing of the capsule 102. In other implementations, of course, other configurations of spring, spring stop, and button may be used.

The receptacle 114 of the receptacle portion 110 may have an overall shape that is generally complementary of the overall shape of the protrusion 112 such that the protrusion 112 may be fully inserted into the receptacle 114. However, as will become clear in later discussion, many such implementations may allow for some amount of gap between the protrusion 112 and the receptacle 114 as a result of accommodating manufacturing process tolerances, clearances for ease of use, and other sources of minor dimensional variation. In some implementations, as discussed earlier, the receptacle 114 may include one or more anti-rotation features 148, the benefits of which will be described in greater detail later in this disclosure.

The receptacle 114 of the receptacle portion 110 may be defined by a plurality of surfaces that extend away from a first mating surface 130, including, for example, a first root surface 154, a first base surface 166, and a first end surface 162 (for additional clarity, these surfaces—as well as various other surfaces discussed herein—are indicated using dotted lines that are minutely offset from the surfaces that they represent). The first root surface 154 and the first base surface 166 generally face each other and define, between them, a cavity that has, as a floor, the first end surface 162. Thus, the first end surface 162 is interposed between the first root surface 154 and the first base surface 166 when viewed along the insertion axis 144. The one or more anti-rotation features 148, if present, may extend upwards from the first end surface 162 in a direction that is generally aligned with the insertion axis 144. The channel 192 may intersect with the receptacle 114 to provide clearance for the button 118 in the receptacle 114; the channel 192 may, in some implementations, have a floor surface 194 that is nominally parallel to the first end surface 162 and/or the first mating surface 130.

The protrusion 112 may have similar, complementary or corresponding surfaces, such as a second mating surface 132, a second root surface 156, a second base surface 168, and a second end surface 164. It will be understood that the ordinal indicators, e.g., "first" and "second," used for the surfaces of the receptacle 114 and the protrusion 112 may be switched (or omitted), as needed, in the claims, if, for example, a surface of the protrusion is recited before a corresponding surface of the receptacle 114 is recited (or if no corresponding surface of the receptacle 114 is recited at all in such a claim).

Such complementary surfaces may generally overlap with one another, and may even be co-extensive with one another, when the insertion portion 108 is fully inserted into the receptacle portion 110 and such surfaces are viewed along directions normal to those surfaces. For example, the second root surface 156 may be coextensive with and overlap with the first root surface 154, with the exception of the region of the second root surface 156 that is missing in the region where the spring stop 122 is located. The term "complementary," as used herein, refers to two surfaces that are structured so as to be adjacent to one another (and possible contacting one another) when the insertion portion 108 is fully inserted into the receptacle portion 110. Such complementary surfaces may, for example, only be separated from one another by a small gap, e.g., a tenth of a millimeter or less, when the insertion portion 108 is fully inserted into the receptacle portion 110. Such complementary surfaces will also generally be parallel to one another when the insertion portion 108 is fully inserted into the receptacle portion 110.

Thus, when the insertion portion 108 is fully inserted into the receptacle portion 110, the first root surface 154 and the second root surface 156, as well as the first base surface 166 and the second base surface 168, may act to prevent translation of the receptacle portion 110 along the translation axis 142 relative to the insertion portion 108; such translation, if any, may, in effect, be limited to the small gap that may exist between such complementary surfaces, e.g., on the order of a tenth of a millimeter, for example.

In some implementations of the low-profile band latch mechanism, the receptacle 114 may further include a first sloped surface 158 that spans between the first root surface 156 and the first end surface 162. The first sloped surface 158 may slope downward from the first root surface 156 towards the first base surface 166 before reaching the first end surface 162. The first sloped surface 158 may a) make it easier for a user to initially insert the insertion portion 108 into the receptacle portion 110 and b) may allow for the receptacle portion 110 to have an exterior surface on the upper side that slopes downward (towards the wearer's wrist) at a much steeper angle than would be possible without the first sloped surface 158. This, in turn, allows for a much steeper departure angle of the straps 104 from the capsule 102, as will be discussed later in this disclosure.

In implementations with anti-rotation features such as the anti-rotation features 148, the anti-rotation features 148 may have first contact surfaces 150 that face towards the first base surface 166 and are separated from the first base surface 166 by a gap. The gap may, for example, be on the order of 0.5 mm to 1 mm, e.g., ~0.7 mm, in some implementations. The first contact surfaces 150, in this example, are semicylindrical in nature, forming the bottoms of the "U" shaped anti-rotation features 148. The anti-rotation features 148 depicted take the form of peninsulas that rise up from the first end surface, like mesas, and that jut out from the first sloped surface 158 towards the first base surface 166. In other implementations, however, the anti-rotation features 148 may take other forms or shapes—as long as the anti-rotation features 148 can be inserted into receiving anti-rotation recesses 146 (not shown here, but visible in FIG. 6) when translated along the insertion axis 144; for example, the anti-rotation features may protrude from the first end surface without contacting other surfaces defining the receptacle. Generally speaking, any prismatic shape, e.g., having a constant cross-section along the insertion axis 144, may be used for the anti-rotation features 148 (with one caveat; the constant cross-section used may, in some implementations, include a slight draft angle, e.g., 1.5°, to aid with insertion and, if injection-molded, mold release and may therefore shrink slightly with increasing distance from the first end surface 162). Thus, for example, the anti-rotation features 148 may, in various implementations, have cross-sections when viewed along the insertion axis 144 that are U-shaped, circular, square, rectangular, trapezoidal, regular polygons, obrounds, and so on. A semi-cylindrical first contact surface 150, as shown in FIG. 5, may be easier to manufacture and may provide better, e.g., more distributed, load transfer between the first contact surface 150 and a second contact surface 152 (see FIG. 6) of the anti-rotation recesses 146.

As with the first root surface 154, the first base surface 166, and the first end surface 162, there may be a complementary second sloped surface 160 on the protrusion 112 for the first sloped surface 158. The first sloped surface 158 and the second sloped surface 160 may, for example, be sloped at an angle of between 15° and 25°, e.g., ~21°, relative to the first root surface 154 and the second root surface 156, respectively, in some implementations. Other slope angles may be used as well, although angles in the range discussed above may provide for an extremely compact, low-profile band latch mechanism that still provides a robust attachment mechanism for the straps 104.

The tooth or teeth 124 of the button 118 may also have various surfaces of interest. The surface of each tooth 124 may, for example, have a chamfered approach surface 174 that is sloped at an angle, e.g., 45° relative to the second base surface 168, so that each tooth 124 exerts an upward, i.e., towards the second root surface 156, force on the button 118 when pushed into contact with the leading edge of the first base surface 166 when the insertion portion 108 is inserted into the receptacle portion 110, thus causing the button 118 to move towards the spring stop 122 and compress the spring 120. When the insertion portion 108 is fully inserted into the receptacle portion 110, the spring 120 may force the button 118 downward, thereby forcing the one or more teeth 124 to translate into one or more corresponding recesses 128 (see FIG. 7) in the first base surface 166. At this point, a first engagement surface 170 of each recess 128 in the first base surface 166 may contact a second engagement surface 172 of each tooth 124. In some implementations, there may be multiple teeth 124 separated by gaps 126, e.g., two teeth 124 separated by a gap 126, that may each have a corresponding recess 128 in the receptacle portion 110. Such recesses 128 may be separated from each other by a wall or other structural feature that may occupy the gap 126 when the insertion portion 108 is fully inserted into the receptacle portion 110. Such an arrangement may provide benefits over implementations in which there is a single tooth 124, even if that single tooth 124 is wider in a direction perpendicular to the translation axis 142 and the insertion axis 144 than the aggregate width of multiple teeth 124 along that axis. For example, under some conditions, e.g., during tensile and torsional loading on the interface between the insertion portion 108 and the receptacle portion 110, the teeth 124 may be forced upwards; once one corner of the second engagement surface 172 of a tooth 124 reaches the first base surface 166, the amount of that tooth 124 that overlaps with the first engagement surface 170 decreases, thereby increasing the pressure on the first engagement surface 170 and the second engagement surface 172 and accelerating the rate of movement of the tooth 124. This will cause the tooth to eventually pop free, releasing the insertion portion 108 from the receptacle portion 110. If multiple teeth 124 are used, however, each tooth 124 may serve as an independent latch, thereby potentially preventing the failure of one tooth 124 to maintain its latching function from causing the entire latched connection to decouple.

Additionally, if a single, large tooth is used, e.g., spanning the same total distance as is spanned by the separate teeth 124, the corresponding recess would need to be at least as wide as the tooth. Such a tooth, when subjected to a pull-out force along the insertion axis 144, may cause the edge of the recess on which the tooth pulls to bow outward, thereby causing an increased risk of failure. Subdividing the recess into multiple recesses separated by one or more walls, such as a wall that fits between the teeth 124, reinforces the edge on which the tooth pulls, thereby reducing the risk of failure.

It will be understood that the various features and elements of the example receptacle portion 110 and the insertion portion 108 discussed herein may exhibit various "nominal" or "general" characteristics, e.g., the first root surface 154 and the first base surface 166 may be described as being nominally parallel or generally parallel (or even just as "parallel," without any "nominally" or "generally" parallel qualifier). In such instances, it will be understood that such descriptions should be interpreted as being inclusive of implementations in which such characteristics deviate slightly from what is described. For example, the protrusion 112 and the receptacle 114 may both be made using injection-molding processes and, to facilitate the use of such manufacturing methods, may include a draft angle, e.g., 1.5°, that introduces a slight taper to the receptacle 114 and/or the protrusion 112. In such cases, the first base surface 166 and the first root surface 154, for example, may appear parallel but in actuality may be at angles relative to each other, e.g., defining a 3° included angle between them. It will be understood that geometrical expressions, e.g., parallel, perpendicular, etc., as used herein are to be interpreted as being inclusive of configurations that include such minor variations. Thus, for example, reference to surfaces that are "parallel" to one another should be viewed as inclusive of surfaces that are truly parallel to one another, as well as of surfaces that are within some angular amount of being parallel with one another, e.g., within ±3°, ±4°, or ±5° of one another.

It will also be understood that while many of the various surfaces discussed herein are planar in nature, e.g., such as the depicted first root surface 154 and the first base surface 166, such surfaces may also be implemented as non-planar surfaces, e.g., having a contoured cross-sectional profile or a curved aspect. In such instances, it is to be understood that such a surface should be viewed as defining an average planar surface that may act as a stand-in for the actual surface for the purposes of evaluating relationships or expressions that appear to assume a planar surface, such as parallelism or perpendicularity. For example, a corrugated surface, e.g., one that has a sine-wave profile, may be viewed as having an average planar surface that coincides with the mid-plane of the sine wave. Thus, a surface that is parallel to such a corrugated surface would be parallel to the mid-plane of the sine-wave. Similarly, a gently curved, spherical surface may have an average planar surface that is parallel to a plane that is tangent to the curved surface at a centroid of the curved surface; such an average planar surface may be positioned such that the amount of surface area of the curved surface on either side of the average plane is approximately equal. The average plane may, for further context, be thought of as analogous to a plane that is determined from a point cloud of data, e.g., such as when a plane is extracted from point cloud data representing measurements of a surface obtained by a three-dimensional scanner. In view of the above, it will be rapidly apparent that expressions such as "the first surface is parallel to the second surface" would not only encompass situations where the first surface and the second surface define an included angle of 3° between them, but would also encompass situations in which the first surface and/or second surface has a contoured profile instead of a planar profile.

Returning to FIGS. 5-10, FIG. 6 depicts a different cross-sectional view; the sectioning plane, in this instance, is parallel to the sectioning plane used in FIG. 5, but passes through the center of one of the anti-rotation features 148. As can be see, the protrusion 112 may have one or more corresponding anti-rotation recesses 146 that are each generally complementary of one of the anti-rotation features 148. Thus, for example, each anti-rotation recess 146 may have a second contact surface 152 that is the complement of a corresponding first contact surface 150 of the receptacle portion 110. In this case, the anti-rotation recesses 146 also serve as counterbores for receiving the screws 138, which are screwed into the threaded interfaces 136 of the housing of the capsule 102 to secure the component with the protrusion 112 to the housing.

FIG. 7 depicts a different cross-sectional view; the sectioning plane, in this instance, is parallel to the sectioning plane used in FIG. 5, but passes through the center of one of the recesses 128.

FIGS. 8 through 10 depict the same cross-sections as shown in FIGS. 5 through 7, respectively, but with the insertion portion 108 fully inserted into the receptacle portion 110.

Figures 11, 12:
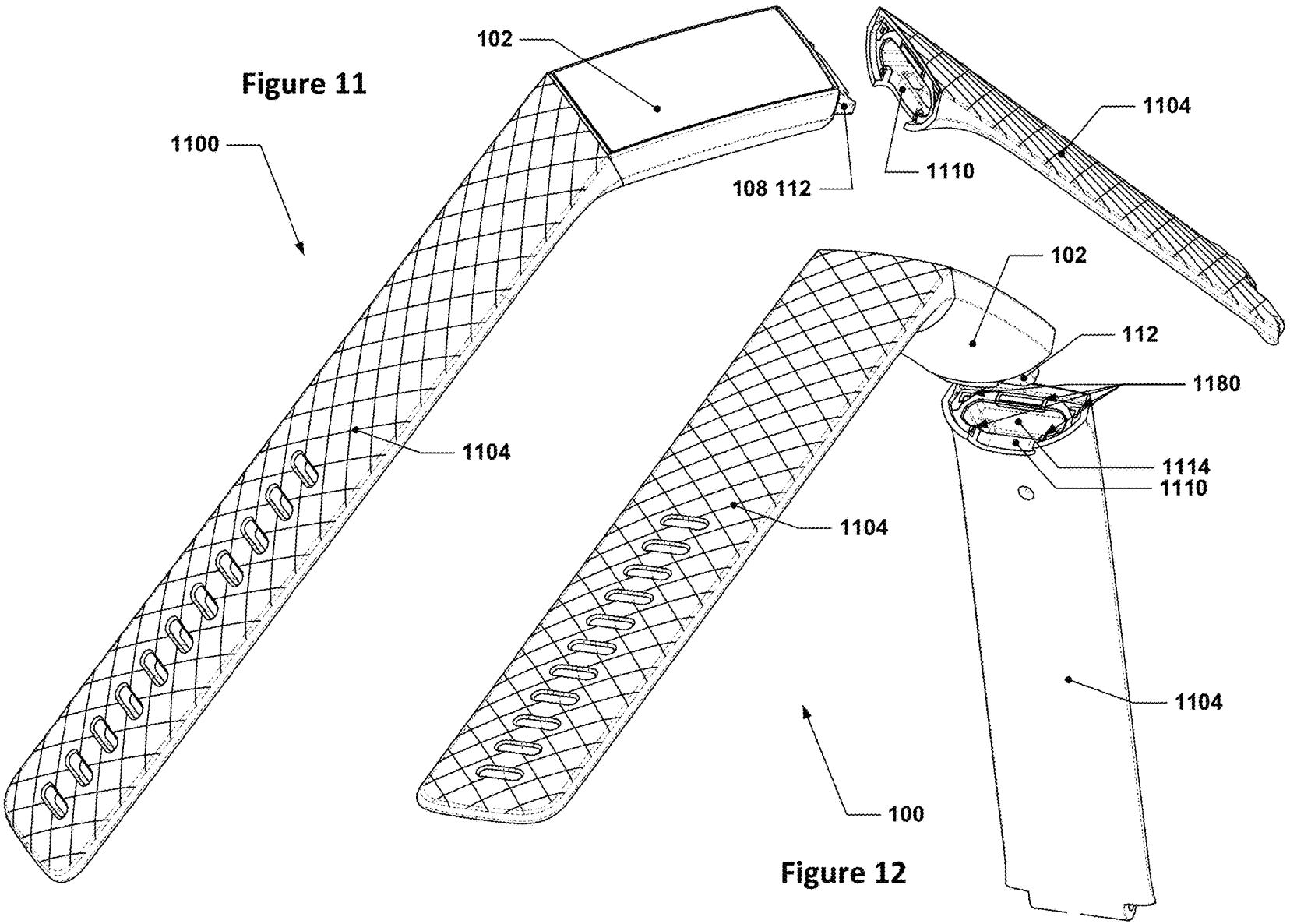
FIG. 11 depicts a perspective view of another example wrist-wearable device with another example low-profile band latch mechanism; one strap is shown detached to allow the example low-profile band latch mechanism to be seen.
FIG. 12 depicts another perspective view of the example wrist-wearable device of FIG. 11.

FIG. 11 depicts a perspective view of another example wrist-wearable device with another example low-profile band latch mechanism; one strap is shown detached to allow the example low-profile band latch mechanism to be seen. FIG. 12 depicts another perspective view of the example wrist-wearable device of FIG. 11. It will be noted that the straps shown in FIGS. 11 and 12 do not include some hardware, such as a buckle and tang clasp or a strap keeper, although actual implementations may include such additional hardware as well.

The example wrist-wearable device of FIGS. 11 and 12 has a capsule 102 that is identical that that of the previous Figures, but features different straps 1104. Whereas the straps 104 were textile or leather straps, e.g., that were looped around strap bars on the receptacle portions 110, the straps 1104 are molded elastomeric straps, e.g., made of thermoplastic polyurethane, silicone, or other soft, flexible material. Such straps may have an integral construction, e.g., receptacle portions 1110 and the straps 1104 may not be movable relative to each other as discrete parts. For example, in some such implementations, the receptacle portion 1110 may take the form of a hard plastic insert, and the strap 1104 may be injection-molded so as to embed the receptacle portion 1110 within the strap 1104. In such manufacturing processes, generally referred to as "overmolding," the softer, elastomeric material of the strap 1104 may be molded around one or more surfaces and/or through various apertures of the receptacle portion 1110 to form, in effect, a bonded, unitary structure. As is likely clear, the low-profile band latch mechanisms discussed herein allow some strap accessories (e.g., the straps with a plurality of adjustment holes—such as the left-most strap in FIG. 11) to be made via a single overmolding process. Other strap accessories may require additional manufacturing steps, e.g., to attach a buckle or other attachment mechanism.

Figure 13:
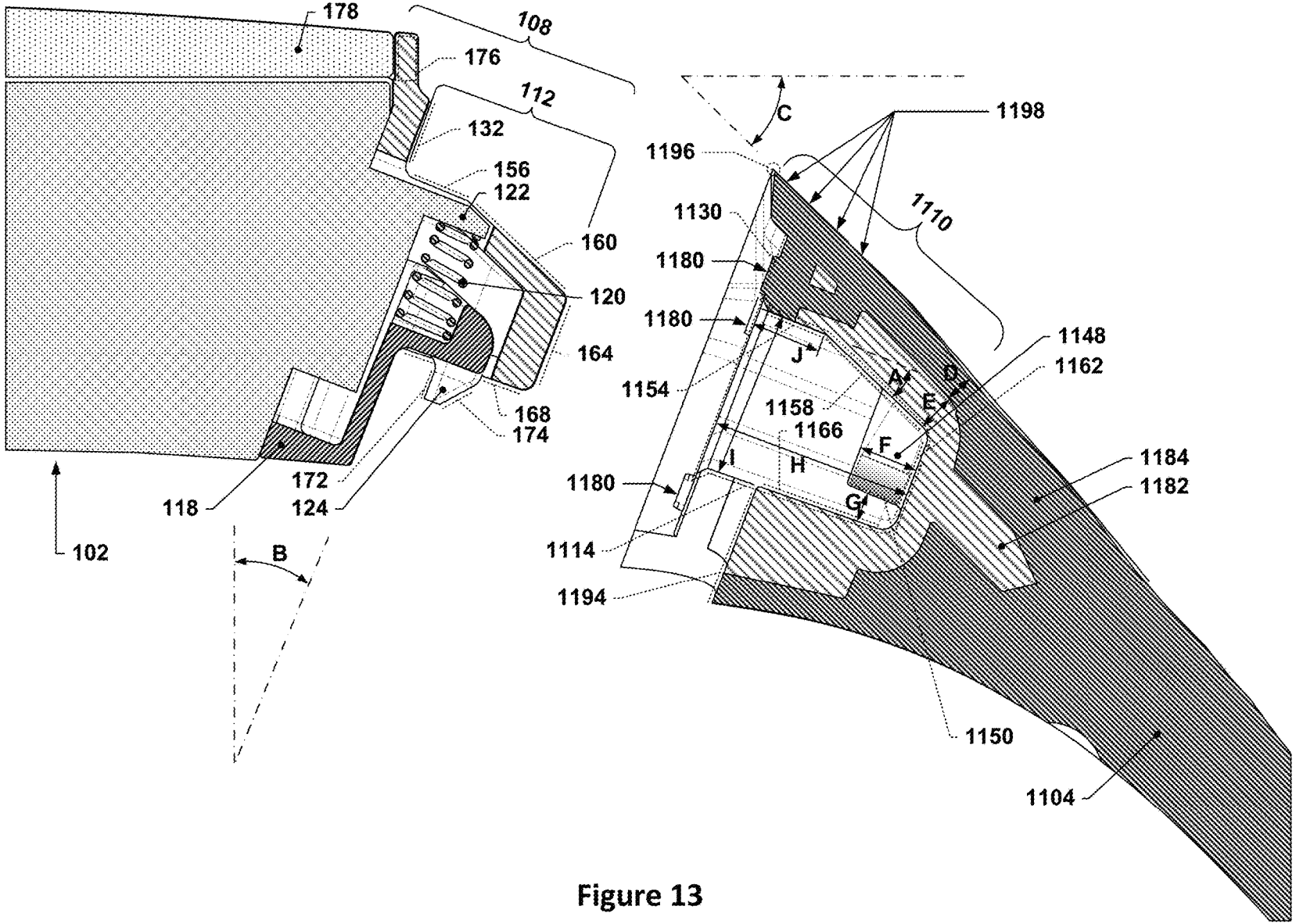
FIG. 13 depicts a detail side section view of the example low-profile band latch mechanism of the example wrist-wearable device of FIG. 11; this section view is taken through the midplane of the example wrist-wearable device of FIG. 11.

FIG. 13 depicts a detail side section view of the example low-profile band latch mechanism of the example wrist-wearable device of FIG. 11; this section view is taken through the midplane of the example wrist-wearable device of FIG. 11. The various features called out generally correspond to similar or analogous features shown in FIG. 5, and, unless otherwise indicated below, callouts with the same last two digits are used to refer to similar structures or features in FIG. 13 as in FIG. 5. In the absence of mention of any specific callout below with respect to FIG. 13, reference to the earlier discussion of the analogue or similar feature in FIG. 5 is appropriate.

As shown in FIG. 13, the receptacle portion 1110 is provided by a co-molded assembly that includes a molded hard plastic or metal insert 1182 and a compliant overmold 1184 that forms the strap 1104 and exterior-facing surfaces of the strap 1104 and the receptacle portion 1110. As can be seen, the compliant overmold 1184 may pass through holes in the plastic insert 1182 (see just above the first root surface 1154, for example) to lock/anchor or otherwise mechanically interlock the overmold 1184 to the insert 1182. In some such implementations, there may be one or more compression mesas 1180, which may be smaller raised areas, e.g., on the order of 0.25 mm in height, that protrude out from the first mating surface 1130 to actually make contact with the second mating surface 132. It will be understood that the first mating surface 1130 is still generally adjacent to the second mating surface 132 in such implementations when the low-profile latch mechanism is connected and may thus still be reasonably viewed as a mating surface even if direct contact does not occur. Alternatively, the compression mesas may simply be viewed as extensions or raised areas of the first mating surface 1130. Such compression mesas 1180 may provide for small features that, due to their small size, may be easily compressed to act as small, low-deflection springs to help provide a contiguous load path between the first mating surface 1130 and the second mating surface 132 should manufacturing tolerance gaps exist between the first mating surface 1130 and the second mating surface 132 when the low-profile band latch mechanism is connected, thereby reducing a perceived feeling of "looseness" between the straps and the capsule.

FIGS. 14 through 16 depict simplified section slices of an example insertion portion and receptacle portion of an example low-profile band latch mechanism in various states of relative rotation. The implementation of FIGS. 14 through 16 are low-profile band latch mechanisms (without the button shown) that do not feature the anti-rotation features discussed herein, but do feature a sloped surface similar to the sloped surface 158. Reference will be made to the various surfaces discussed earlier, although specific numeric callouts are not provided since the identity of these surfaces will be apparent from the previous discussion. Manufacturing sloped surfaces, such as the first sloped surface 158, at high tolerances may be problematic, as multiple datum points/machining settings must be properly set in order to achieve the desired tolerance. As a result, the accuracy of sloped surfaces may be less than that of more vertical or horizontal surfaces, and the potential gap between the first sloped surface 158 and the second sloped surface 160 may be large enough that there may be a potential for the insertion portion 1408 to rotate relative to the receptacle portion 1410 in a way that causes the insertion portion 1408 to disengage from the receptacle portion 1410 or, at the very least, develop potentially undesirable visible gaps between the insertion portion 1408 and the receptacle portion 1410. This is illustrated in FIGS. 15 and 16.

In FIG. 14, the insertion portion 1408 is pressed against the first base surface of the receptacle portion 1410, thereby generating a maximum amount of gap between the first sloped surface and the second sloped surface. In FIG. 15, the insertion portion 1408 has now been subjected to a torque that causes the insertion portion 1408 to effectively pivot about point located on the leading edge of the first base surface of the receptacle portion 1410 until the corner where the second sloped surface and the second end surface of the insertion portion 1408 meet contacts the first sloped surface of the receptacle portion 1410. Due to the clearances between the receptacle portion 1410 and the insertion portion 1408, a gap X opens up between the receptacle portion 1410 and the insertion portion 1408 near the uppermost portion of the low-profile band latch mechanism, which is the most visible portion of this interface. Such a gap is visually unappealing and contributes to a feeling of "looseness" and poor fit in the components if noticed by the wearer. While such a gap could potentially be reduced or avoided by making the clearances between the receptacle portion 1410 and the insertion portion 1408 much tighter, tightly tolerance surfaces/parts decrease part yield, require higher precision manufacturing equipment, and/or require expensive additional operations to bring mating surfaces into tolerance specifications. The mechanisms discussed herein, however, allow for a tighter fit without needing to resort to such costly avenues.

In FIG. 16, the insertion portion 1408 has been rotated still further, causing interference between the corner where the second sloped surface and the second end surface of the insertion portion 1408 meet and the first sloped surface of the receptacle portion 1410. Such interference may be accommodated by flexure, e.g., if the thin wall of the receptacle portion 1410 deflects or deforms in the vicinity of the contact location, or, for example, by wear and tear, e.g., the corner may be worn down due to normal wear and tear, thereby permitting greater amounts of rotation before contact occurs. As can be seen, the gap X' between the insertion portion 1408 and the receptacle portion 1410 is significantly larger than the gap X discussed above; in the extreme case, the insertion portion 1408 may rotate sufficiently that the one or more teeth that latch it to the receptacle portion 1410 may unlatch, allowing the insertion portion 1408 to rotate completely out of the receptacle portion 1410. This may cause the wrist-wearable device to fall off the wearer's wrist, resulting possible loss or damage.

The anti-rotation features discussed earlier may be used to prevent such a possible occurrence. FIGS. 17 and 18 depict simplified section slices of another example insertion portion and receptacle portion of another example low-profile band latch mechanism in various states of relative rotation. In FIGS. 17 and 18, the same low-profile band latch mechanism as shown in FIGS. 14 through 16 has been modified to include an anti-rotation feature similar to that discussed earlier. As a result, when rotation of the insertion portion 1408 relative to the receptacle portion 1410 occurs, as is shown in FIG. 18, a much smaller gap Y opens up in the interface between the insertion portion 1408 and the receptacle portion 1410 as compared with the gap X. Moreover, the possibility of further rotation past this point is much reduced since there is no significant possibility of "sliding" contact or movement between the first contact surface and the second contact surface, as compared to the potential sliding movement of the corner where the second sloped surface and the second end surface meet relative to the first sloped surface.

It should be noted that low-profile band latch mechanisms as discussed herein provide an extremely compact, easy-to-use latching mechanism for attaching straps and similar accessories to a watch or fitness monitoring capsule/housing. Such structures and concepts may be particularly well-suited for use in systems where a high departure angle is desired for the straps. The departure angle, as the term is used herein, is the angle defined between the plane defined by the main display of the wrist-wearable device (or the cover glass) and the plane associated with the outermost surface of each strap where the strap departs the housing to which it is connected. Thus, for example, if the straps were tangent with the cover glass where they butt up against the cover glass, the departure angle would be 0°, and the straps would then need to travel some distance outwards from the housing before curving down towards the wearer's wrist. In contrast, the departure angle of the strap 1104 of FIG. 13 is nearly 45°. This allows the wrist-wearable device to be much lower profile than with other latch designs, reducing the bulkiness of the wrist-wearable device, reducing the possibility of snags on clothing or other impediments, and providing a more aesthetic overall appearance.

To give some sense of the scale of a typical low-profile band latch mechanism, various dimensions have been flagged in FIG. 13 with letter callouts. In the depicted variant, the first sloped surface 1158 is at approximately a 21° slope (angle "A") from the first root surface 1154. The first sloped surface 1158 is sloped to allow an exterior surface 1198 of the strap 1104 that is overmolded with and overlaps the receptacle portion 1110 to follow a similar sloped contour. In the depicted example, the second mating surface 1132 is at an angle of approximately 21° (angle "B") from a normal to the cover glass 178, so when the receptacle portion 1110 is connected with the insertion portion 108, the combined slopes of "A" and "B" allow the exterior surface 1198 to have a departure angle "C" that is approximately 40-45° (the departure angle refers to the angle between the exterior surface 1198 and a plane generally coincident with the cover glass 1178 or the display surface underneath it). Since the exterior surface 1198 is able to adopt such a departure angle immediately at the edge 1196 that butts up against the capsule 102, the strap 1104 is able to tightly follow curvature of the wearer's wrist, thereby reducing the profile of the wrist-wearable device and the perceived length of the device, which makes the wrist-wearable device better suited for being worn by people with smaller wrist diameters.

With regard to linear dimensions, the example low-profile band latch mechanism has a receptacle 1114 that is approximately 5 mm deep by 4 mm tall. For example, dimension "H" may be approximately 5 mm and dimension "I" may be approximately 4.15 mm. The first root surface 1154 may be approximately 1.67 mm in length (dimension "J") and the anti-rotation features 1148 may protrude out approximately 1.5 mm (dimension "F") from the first end surface 1162 and may have first contact surfaces 1150 that are offset from the first base surface 1166 by approximately 0.7 mm (dimension "G"). Such dimensions allow the walls of the insert 1182 for the receptacle portion to be kept at least at a thickness (dimension "E") of approximately 1 mm, which may be more easily manufactured using injection-molding techniques. Similarly, the overmolded portion of the strap may be kept to a thickness (dimension "D") of at least 0.75 mm, thereby providing sufficient material to produce a robust outer layer to the strap 1104. It will be understood that other dimensional values may be used as well and that the above dimensional values are merely provided to give context for how compact the low-profile band latch mechanisms discussed herein may be.

It is to be understood that the phrase "for each <item> of the one or more <items>," if used herein, should be understood to be inclusive of both a single-item group and multiple-item groups, i.e., the phrase "for . . . each" is used in the sense that it is used in programming languages to refer to each item of whatever population of items is referenced. For example, if the population of items referenced is a single item, then "each" would refer to only that single item (despite the fact that dictionary definitions of "each" frequently define the term to refer to "every one of two or more things") and would not imply that there must be at least two of those items.

It is to be further understood that the above disclosure, while focusing on a particular example implementation or implementations, is not limited to only the discussed example, but may also apply to similar variants and mechanisms as well, and such similar variants and mechanisms are also considered to be within the scope of this disclosure.

What is claimed is:

1. An apparatus comprising:

a receptacle portion for a strap of a wrist-wearable device, the receptacle portion including:

a first mating surface configured to butt up against a corresponding second mating surface of an insertion portion with which the receptacle portion is configured to connect; and a receptacle having a first root surface, a first end surface, and a first base surface, wherein:

the first root surface faces towards the first base surface, the first base surface faces towards the first root surface, and the first root surface and the first base surface are interposed between the first mating surface and the first end surface;

one or more anti-rotation features, wherein:

at least one of the one or more anti-rotation features protrudes from the first end surface towards the first mating surface, and each of the at least one of the one or more anti-rotation features has a corresponding first contact surface that faces towards the first base surface and is separated from the first base surface by a first gap; and one or more recesses in the first base surface.

2. The apparatus of claim 1, further comprising:

a first sloped surface, wherein:

the first sloped surface is interposed between the first end surface and the first root surface, the first sloped surface faces towards the first root surface, and the first sloped surface forms an angle with the first base surface such that a distance between the first sloped surface and the first base surface as measured along a direction perpendicular to the first base surface increases with increasing distance from the first end surface.

3. The apparatus of claim 1, wherein the receptacle portion includes an injection-molded insert made from a material selected from the group consisting of: metal and rigid plastic, and the apparatus further includes a strap that is overmolded onto the receptacle portion, thereby embedding the insert into the strap.

4. The apparatus of claim 3, wherein:

the strap has an exterior surface in a portion of the strap that overmolds the receptacle portion, the exterior surface has an edge that is configured to be adjacent to the insertion portion when the receptacle portion is connected with the insertion portion, the edge is nominally parallel to the first base surface and the first end surface, the exterior surface is sloped such that a distance between the exterior surface and the first base surface along a first axis normal to the first base surface decreases with increasing distance between the first axis and the edge, and the exterior surface forms an angle of between 20° and 25° with the first base surface.

5. The apparatus of claim 4, wherein the exterior surface and the first mating surface form an angle of between 60° and 70°.

6. The apparatus of claim 1, wherein:

the receptacle portion further includes: a) a strap bar extending in a direction transverse to the first end surface, b) a main body that houses the receptacle, and c) at least one support leg, the strap bar is offset from the main body by a second gap to permit a strap to pass through the second gap and between the main body and the strap bar, and each support leg spans between the strap bar and the main body.

7. The apparatus of claim 1, wherein:

there are a plurality of recesses in the first base surface, the recesses are arranged in a linear array along an axis that is nominally parallel to the first end surface and the first base surface, and each recess is spaced apart from any neighboring recess or recesses by a first distance.

8. The apparatus of claim 1, wherein there are a plurality of anti-rotation features that are spaced apart from one another along an axis that is nominally parallel to the first end surface and the first base surface.

9. The apparatus of claim 1, wherein each of the at least one of the one or more anti-rotation features is a peninsula that extends towards the first base surface from a surface selected from the group consisting of: the first root surface and a surface spanning between the first root surface and the first end surface.

10. The apparatus of claim 1, wherein:

each of the at least one of the one or more anti-rotation features has a cross-section when viewed along an axis normal to the first end surface, and the cross-section is selected from the group consisting of: a U-shaped cross-section, a circular cross-section, a square cross-section, a rectangular cross-section, a trapezoidal cross-section, a regular polygon cross-section, and an obround cross-section.

11. The apparatus of claim 1, wherein each of the at least one of the one or more anti-rotation features is a mesa that protrudes from the first end surface without contacting other surfaces defining the receptacle.

12. The apparatus of claim 1, wherein the first contact surface of each of the at least one of the one or more anti-rotation features is nominally semi-cylindrical.

13. The apparatus of claim 1, wherein:

the receptacle portion further includes a channel extending from an exterior surface of the receptacle portion to the first base surface, the channel includes a floor surface that is nominally parallel to the first end surface and that is interposed between the first mating surface and the first end surface, the channel extends up to the first mating surface, and the one or more recesses are interposed between the channel and the first end surface.

14. The apparatus of claim 1, further comprising the insertion portion, wherein:

the insertion portion includes a protrusion with a second base surface, a second root surface, and a second end surface;

the second root surface faces away from the second base surface, the second base surface faces away from the second root surface, the second base surface, the second end surface, and the second root surface are complements of the first base surface, the first end surface, and the first root surface, respectively, the protrusion includes a corresponding anti-rotation recess for each of the at least one of the one or more anti-rotation features of the receptacle portion, each anti-rotation recess extends into the second end surface and has a second contact surface facing away from the second base surface, and the second contact surface is a complement of the first contact surface and is configured to contact the first contact surface when the protrusion is fully inserted into the receptacle.

15. The apparatus of claim 14, wherein:

the insertion portion further includes a button and a spring, the button has one or more teeth, each tooth corresponds with a recess of the one or more recesses in the first base surface, the button is configured to translate along a translation axis that is nominally perpendicular to the second base surface, the spring is configured to press the button against the first base surface when the protrusion is fully inserted into the receptacle, and each tooth is positioned so as to protrude into the corresponding recess when the protrusion is fully inserted into the receptacle and the button is pressed against the first base surface.

16. The apparatus of claim 15, wherein the insertion portion further includes a guide and a spring stop, wherein:

the guide is configured to substantially limit movement of the button to translation along the translation axis, the spring stop is located at one end of the guide, and the spring is interposed between the button and the spring stop.

17. The apparatus of claim 16, further comprising a housing of the wrist-wearable device, wherein:

the guide and the spring stop are features on the housing, the protrusion is provided, at least in part, by a separate component that is attached to the housing, the separate component includes one or more button stops configured to engage with surfaces of the button to limit travel of the button away from the spring stop to a first distance, the spring is configured to press the button against the one or more button stops when the button is otherwise unloaded, and the button has a surface that is flush with a surface of the housing when the button is positioned at the first distance away from the spring stop.

18. The apparatus of claim 16, further comprising a metal housing of the wrist-wearable device and a cover glass of the wrist-wearable device, wherein:

the insertion portion is adjacent to the metal housing and the cover glass, the metal housing includes a display unit, the cover glass covers the display unit, and the insertion portion includes a plastic rim lip that is interposed between a) the cover glass and at least a portion of the metal housing and b) the first mating surface when the protrusion is fully inserted into the receptacle.

19. A wearable device strap kit, the kit including two apparatuses of claim 1, with one of the apparatuses connected with a first end of a first strap and the other of the apparatuses connected with a first end of a second strap, wherein a second end of the first strap opposite the first end of the first strap includes one or more features that are configured to adjustably secure the second end of the first strap to the second strap.

20. An apparatus comprising:

an insertion portion for a wrist-wearable device, the insertion portion including:

a first mating surface configured to butt up against a corresponding second mating surface of a receptacle portion with which the insertion portion is configured to connect;

the insertion portion includes a protrusion with a first base surface, a first root surface, and a first end surface;

the first root surface faces away from the first base surface;

the first base surface faces away from the first root surface;

the first root surface and the first base surface are interposed between the first mating surface and the first end surface;

the protrusion includes one or more anti-rotation recesses;

at least one of the one or more anti-rotation recesses extends into the first end surface and has a first contact surface facing away from the first base surface;

a button that has one or more teeth and is transitionable between a first configuration and a second configuration; and one or more springs that are configured to urge the button into the first configuration, wherein:

the one or more teeth, when the button is in the first configuration, are proud of the first base surface, and the one or more teeth, when the button is in the second configuration, are at least partially withdrawn into the insertion portion as compared with the first configuration.

* * * * *